US008190037B2

(12) United States Patent
Nakazato et al.

(10) Patent No.: US 8,190,037 B2
(45) Date of Patent: May 29, 2012

(54) FAULT PREDICTION METHOD, FAULT PREDICTION SYSTEM, AND IMAGE FORMING APPARATUS

(75) Inventors: Yasushi Nakazato, Tokyo (JP); Osamu Satoh, Sagamihara (JP); Kohji Ue, Ebina (JP); Masahide Yamashita, Tokyo (JP); Jun Yamane, Yokohama (JP)

(73) Assignee: Ricoh Company, Limited, Tokyo (JP)

( * ) Notice: Subject to any disclaimer, the term of this patent is extended or adjusted under 35 U.S.C. 154(b) by 490 days.

(21) Appl. No.: 12/487,835

(22) Filed: Jun. 19, 2009

(65) Prior Publication Data

US 2009/0319827 A1 Dec. 24, 2009

(30) Foreign Application Priority Data

Jun. 23, 2008 (JP) ..... 2008-163008

(51) Int. Cl.
*G03G 15/00* (2006.01)

(52) U.S. Cl. ..... 399/9

(58) Field of Classification Search ..... 399/9, 10, 399/45, 91

See application file for complete search history.

(56) References Cited

U.S. PATENT DOCUMENTS

| | | | |
|---|---|---|---|
| 5,225,873 | A | 7/1993 | Lux et al. |
| 5,387,965 | A | 2/1995 | Hasegawa et al. |
| 5,606,408 | A | 2/1997 | Yano et al. |
| 5,638,159 | A | 6/1997 | Kai et al. |
| 5,740,494 | A | 4/1998 | Shoji et al. |
| 5,765,087 | A | 6/1998 | Yano et al. |
| 5,923,834 | A | 7/1999 | Thieret et al. |
| 6,799,012 | B2 | 9/2004 | Shakuto et al. |
| 6,819,892 | B2 | 11/2004 | Nakazato et al. |
| 6,937,830 | B2 | 8/2005 | Satoh |
| 6,987,944 | B2 | 1/2006 | Shakuto et al. |
| 7,027,751 | B2 | 4/2006 | Miura et al. |
| 7,103,301 | B2 | 9/2006 | Watanabe et al. |
| 7,110,917 | B2 | 9/2006 | Matsuura et al. |
| 7,184,674 | B2 | 2/2007 | Satoh et al. |
| 7,218,879 | B2 | 5/2007 | Enoki et al. |
| 7,444,097 | B2 | 10/2008 | Suzuki et al. |
| 2003/0020760 | A1 | 1/2003 | Takatsu et al. |
| 2005/0058474 | A1 | 3/2005 | Watanabe et al. |
| 2006/0294252 | A1 | 12/2006 | Shoji et al. |
| 2007/0258723 | A1 | 11/2007 | Nakazato et al. |
| 2008/0068639 | A1 | 3/2008 | Satoh et al. |
| 2008/0075476 | A1 * | 3/2008 | Nakazato et al. ..... 399/15 |
| 2008/0199193 | A1 * | 8/2008 | Nakazato et al. ..... 399/49 |

(Continued)

FOREIGN PATENT DOCUMENTS

| | | |
|---|---|---|
| EP | 1 156 379 A2 | 11/2001 |

(Continued)

*Primary Examiner* — David Gray
*Assistant Examiner* — Rodney Bonnette
(74) *Attorney, Agent, or Firm* — Oblon, Spivak, McClelland, Maier & Neustadt, L.L.P.

(57) ABSTRACT

A fault prediction method predicts a plurality of faults in a target device, and includes the steps of collecting internal information of the target device output from the target device, generating one or more criteria for defining a deviation from a normal state based on the collected internal information of the target device, incorporating the one or more criteria into a device state discriminator, identifying a deviation from a normal state in the target device according to the one or more criteria using the device state discriminator, and outputting a fault prediction as a result of the identifying step to a user. One or more of the steps are performed by a processor.

8 Claims, 19 Drawing Sheets

U.S. PATENT DOCUMENTS

| | | | | |
|---|---|---|---|---|
| 2009/0034990 | A1 * | 2/2009 | Nakazato et al. | 399/9 |
| 2009/0041481 | A1 | 2/2009 | Iida et al. | |
| 2009/0322524 | A1 | 12/2009 | Nakazato et al. | |

FOREIGN PATENT DOCUMENTS

| | | | |
|---|---|---|---|
| EP | 1 156 379 | A3 | 11/2001 |
| JP | 5-100517 | | 4/1993 |
| JP | 5-281809 | | 10/1993 |
| JP | 5-323740 | | 12/1993 |
| JP | 7-36323 | | 2/1995 |
| JP | 7-104616 | | 4/1995 |
| JP | 7-104619 | | 4/1995 |
| JP | 8-137344 | | 5/1996 |
| JP | 8-314530 | | 11/1996 |
| JP | 11-296027 | | 10/1999 |
| JP | 2000-89623 | | 3/2000 |
| JP | 2001-175328 | | 6/2001 |
| JP | 2001-356655 | | 12/2001 |
| JP | 2004-219617 | | 8/2004 |
| JP | 2005-17874 | | 1/2005 |
| JP | 2005-227518 | | 8/2005 |
| JP | 2000-270141 | | 7/2006 |
| WO | WO 02/21152 | A2 | 3/2002 |
| WO | WO 02/21152 | A3 | 3/2002 |

* cited by examiner

FAULT PREDICTION METHOD, FAULT PREDICTION SYSTEM, AND IMAGE FORMING APPARATUS

CROSS-REFERENCE TO RELATED APPLICATIONS

The present application is based on and claims priority from Japanese Patent Application No. 2008-163008, filed on Jun. 23, 2008 in the Japan Patent Office, the entire contents of which are hereby incorporated herein by reference.

BACKGROUND OF THE INVENTION

1. Field of the Invention

Exemplary aspects of the present invention relate to a fault prediction method, a fault prediction system, and an image forming apparatus, and more particularly, to a fault prediction method, a fault prediction system, and an image forming apparatus for efficiently predicting a failure of an image forming apparatus.

2. Description of the Related Art

When various conventional devices such as image forming apparatuses malfunction, users cannot use the devices until they are repaired, causing inconvenience to the user. In particular, due to their complexity, electrophotographic image forming apparatuses with their many components tend to suddenly malfunction unless periodic maintenance on each component is performed.

Such malfunctions, or failures, can have several causes. As well as frictional wear from ordinary operation, the presence of harmful materials such as paper powder, wear of a cleaning member such as a cleaning blade and the like, and so on, also can cause the performance of the image forming apparatuses to gradually deteriorate, resulting in reduced imaging quality such as the production of defective images with vertical streaks extending in a direction corresponding to a direction of movement of a surface of an image carrier, blurred images, spotted images, images with background soiling, or the like. However, even these problems do not affect the basic ability of the image forming apparatus to form images, so that the image forming apparatus keeps working until a user encounters such defective image. As a result, the user has to re-input the image formation command as well as fix the problem, thus wasting time and resources.

Therefore, various prediction methods of predicting such failure of an image forming apparatus are provided.

One method predicts failure of an image forming apparatus using an assumed useful life of the apparatus and monitors the operating time of the image forming apparatus. FIG. 1 is a graph illustrating one example of image forming apparatus failure prediction based on time series analysis. A counter counts an accumulated operating time (a counter value) of each component or part of a photoconductor, a development device, or the like. When the counter value reaches a value indicating the end of the useful life of that component or part has been reached as defined based on results of endurance tests or the like, failure of the image forming apparatus is predicted. However, the prediction is not very precise, since the useful life of the image forming apparatus may vary considerably depending on the operating environment and how the apparatus is used.

Another related-art prediction method starts predicting a failure of an image forming apparatus immediately after the image forming apparatus is delivered to a user. The method involves acquiring a reference data group of a plurality of sets of data on operating states of each of a plurality of image forming apparatuses of the same model as the image forming apparatus during test operation thereof. The reference data group is then used as an initial reference data group for determining a formula for calculating an index value used to discriminate among different operating states of the apparatus. After the image forming apparatus starts to work, data of the reference data group is acquired and added thereto.

Yet another known related-art fault prediction method is a boosting method that creates a high-precision device state discriminator by combining a plurality of sub-discriminators having a low degree of precision. In state discrimination of an image forming apparatus using the boosting method, each sub-discriminator determines whether internal information, such as sensor readings, digitized information on operational control of each device, or the like, indicates a normal state or a malfunction state. In this case, a malfunction state or a state of malfunction means either a state of failure (failure state) or a state such that imminent failure of the apparatus is predictable. The readings of each sub-discriminator are weighted and the weighted results are added together to determine whether the image forming apparatus is in a state of malfunction.

The above related-art prediction method can predict a specific failure of a device that is detectable when the device is manufactured. However, the method cannot predict other kinds of fault found to be detectable after manufacturing, that is, during actual usage. Therefore, downtime of the image forming apparatus is not reduced.

Accordingly, there is a need for a technology capable of providing a method of predicting various probable failures of an image forming apparatus to reduce total downtime thereof.

BRIEF SUMMARY OF THE INVENTION

This specification describes a fault prediction method according to illustrative embodiments of the present invention. In one illustrative embodiment of the present invention, the fault prediction method includes the steps of collecting internal information of the target device output from the target device, generating one or more criteria for defining a deviation from a normal state based on the collected internal information of the target device, incorporating the one or more criteria into a device state discriminator, identifying a deviation from a normal state in the target device according to the one or more criteria using the device state discriminator, and outputting a fault prediction as a result of the identifying step to a user. One or more of the steps are performed by a processor.

This specification further describes a fault prediction system according to illustrative embodiments of the present invention. In a further illustrative embodiment of the present invention, the fault prediction system predicts a plurality of faults in a target device, and includes an information collector, a criterion generator, a criterion incorporator, and a communication interface. The information collector is configured to collect internal information of the target device output from the target device. The criterion generator is configured to generate one or more criteria for defining a deviation from a normal state based on the internal information of the target device collected by the information collector. The criterion incorporator is configured to incorporate the one or more criteria into a device state discriminator. The communication interface is configured to output a fault prediction made by the device state discriminator.

This specification further describes an image forming apparatus according to illustrative embodiments of the present invention. In a further illustrative embodiment of the present invention, the image forming apparatus includes a device state discriminator, an information collector, an input receiver, a criterion incorporator, and a communication interface. The device state discriminator is configured to predict a plurality of faults in the image forming apparatus based on internal information of the image forming apparatus. The information collector is configured to collect the internal information. The input receiver is configured to receive input of criterion data showing one or more criteria for defining a deviation from a normal state in the image forming apparatus. The criterion incorporator is configured to incorporate the one or more criteria into the device state discriminator. The communication interface is configured to output a fault prediction made by the device state discriminator to a user.

BRIEF DESCRIPTION OF THE DRAWINGS

A more complete appreciation of the invention and the many attendant advantages thereof will be more readily obtained as the same becomes better understood by reference to the following detailed description when considered in connection with the accompanying drawings, wherein.

DETAILED DESCRIPTION OF THE INVENTION

Figure 1:
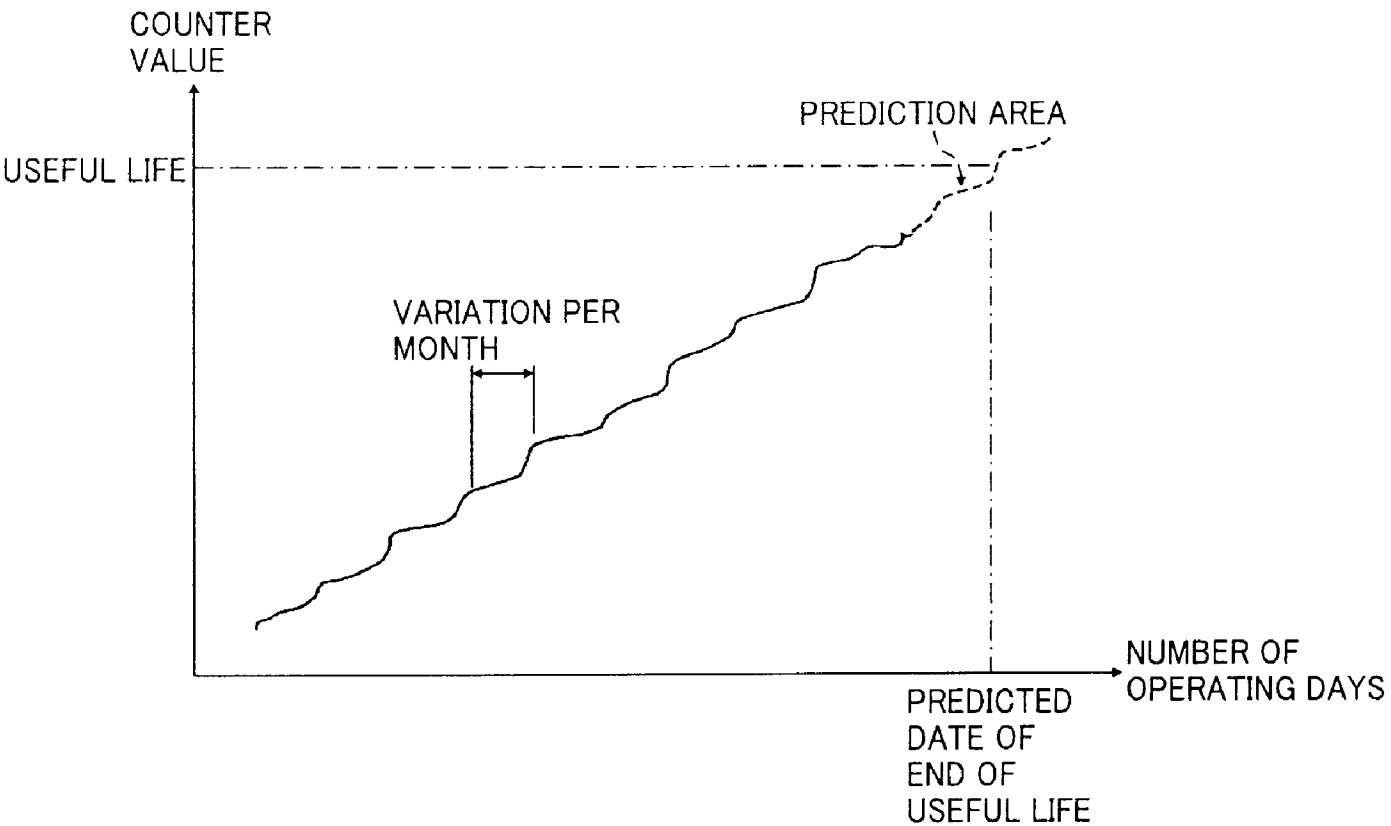
FIG. 1 RELATED ART
FIG. 1 is a graph illustrating one example of a related-art fault prediction of an image forming apparatus based on time series analysis.

In describing illustrative embodiments illustrated in the drawings, specific terminology is employed for the sake of clarity. However, the disclosure of this specification is not intended to be limited to the specific terminology so selected, and it is to be understood that each specific element includes all technical equivalents that operate in a similar manner and achieve a similar result.

Figure 2:
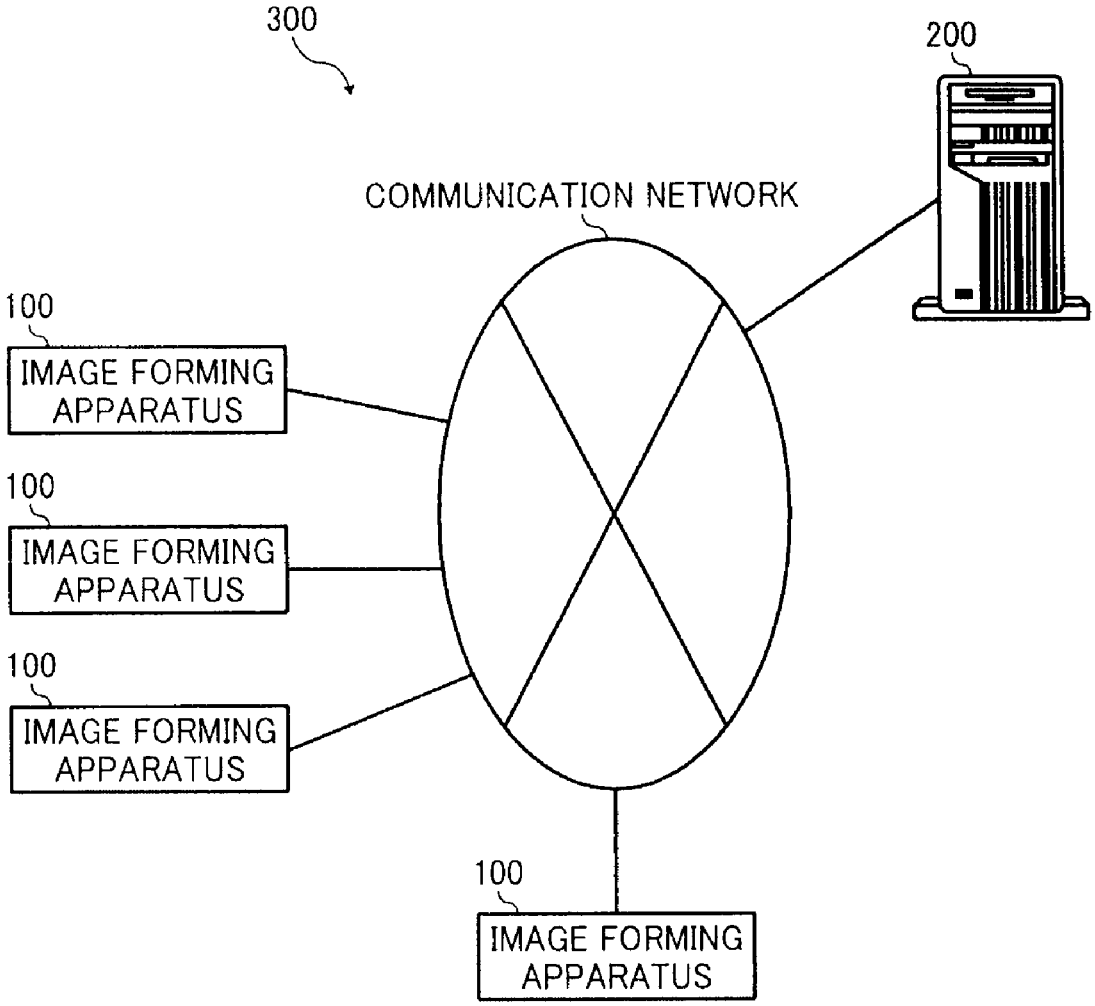
FIG. 2 is a schematic diagram of a fault prediction system according to one illustrative embodiment.

Referring now to the drawings, wherein like reference numerals designate identical or corresponding parts throughout the several views, in particular to FIG. 2, a fault prediction system 300 according to an illustrative embodiment of the present invention is described.

FIG. 2 is a schematic view of the fault prediction system 300. The fault prediction system 300 includes a plurality of image forming apparatuses 100 and a management device 200.

The plurality of image forming apparatuses 100 is a printer of a same model, and already delivered to a user and installed in a particular place. The plurality of image forming apparatuses 100 is connected to the management device 200 via a communication network used for the Internet or the like and communicates with the management device 200. It is to be noted that the fault prediction system 300 may include a single image forming apparatus 100 and the management device 200. Alternatively, the fault prediction system 300 may include merely a single image forming apparatus 100.

Figure 3:
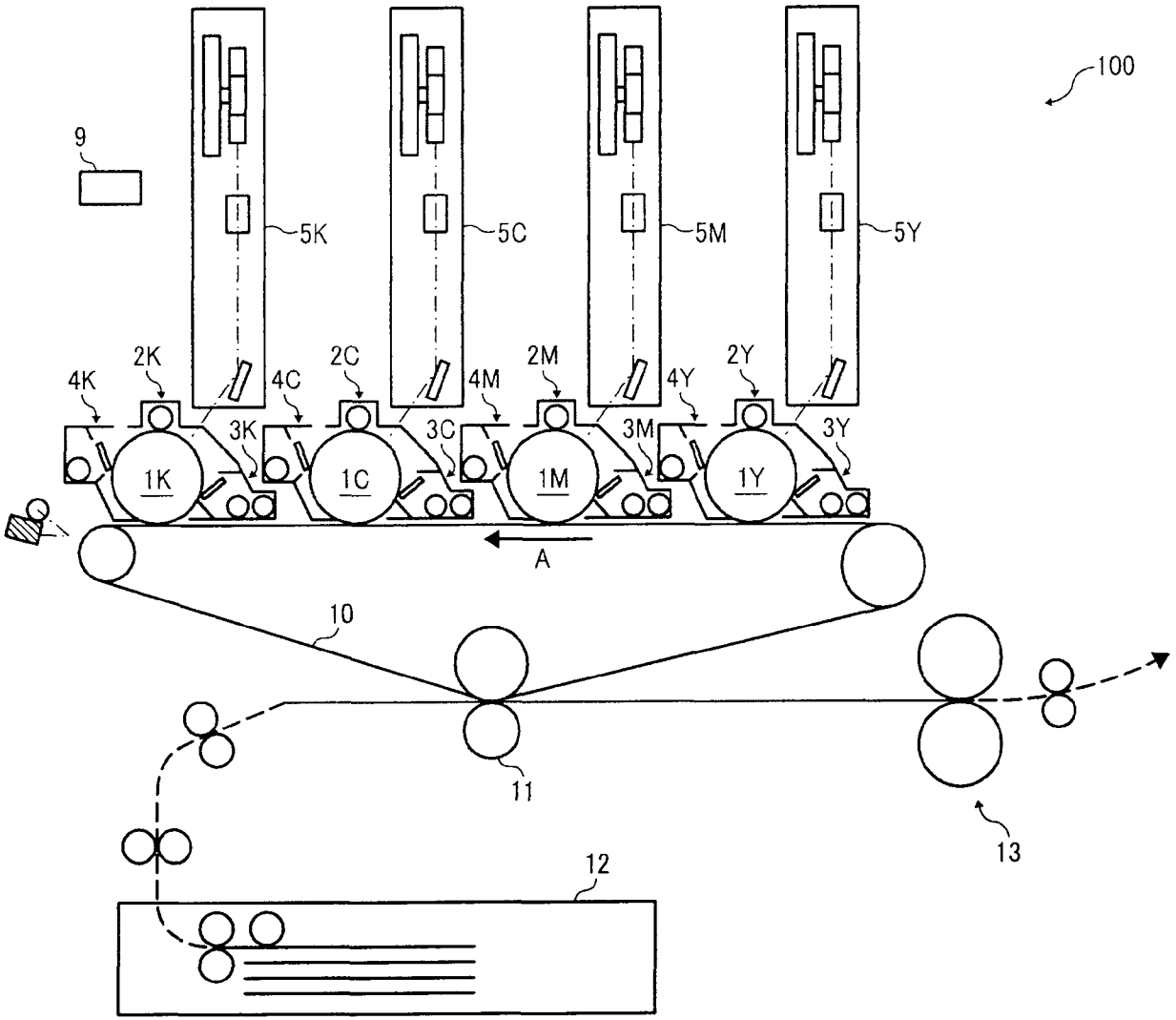
FIG. 3 is a schematic sectional view of an image forming apparatus included in the fault prediction system shown in FIG. 2.

Referring to FIG. 3, a description is now given of a structure of the image forming apparatus 100. FIG. 3 is a schematic sectional view of the tandem-type image forming apparatus 100. The image forming apparatus 100 includes photoconductors 1Y, 1M, 1C, and 1K, an intermediate transfer belt 10, charging devices 2Y, 2M, 2C, and 2K, development devices 3Y, 3M, 3C, and 3K, cleaners 4Y, 4M, 4C, and 4K, exposure devices 5Y, 5M, 5C, and 5K, a secondary transfer roller 11, a feeding device 12, a fixing device 13, and a controller 9.

Around the photoconductors 1Y, 1M, 1C, and 1K, serving as image carriers, there are provided the charging devices 2Y, 2M, 2C, and 2K, the development devices 3Y, 3M, 3C, and 3K, the cleaners 4Y, 4M, 4C, and 4K, and the exposure devices 5Y, 5M, 5C, and 5K, respectively. After the charging devices 2Y, 2M, 2C, and 2K uniformly charge respective surfaces of the photoconductors 1Y, 1M, 1C, and 1K with a predetermined electrical potential, the exposure devices 5Y, 5M, 5C, and 5K, serving as latent image forming devices and including a laser diode, expose the charged surfaces of the photoconductors 1Y, 1M, 1C, and 1K to form yellow, magenta, cyan, and black electrostatic latent images thereon, respectively. Then, the development devices 3Y, 3M, 3C, and 3K develop the electrostatic latent images formed on the photoconductors 1Y, 1M, 1C, and 1K with respective color toner, thereby forming toner images on the surfaces of the photoconductors 1Y, 1M, 1C, and 1K. The respective color toner images are sequentially transferred to the intermediate transfer belt 10 and superimposed on each other. After transfer, the cleaners 4Y, 4M, 4C, and 4K remove residual toner remaining on the surfaces of the photoconductors 1Y, 1M, 1C, and 1K, respectively.

As the intermediate transfer belt 10 moves in a direction A, the superimposed toner image transferred to the intermediate transfer belt 10 is conveyed to a secondary transfer area in which the secondary transfer roller 11 opposes an outer circumferential surface of the intermediate transfer belt 10. A sheet as a recoding material stored in the feeding device 12 is properly fed to the secondary transfer area, when the toner image transferred to the intermediate transfer belt 10 is conveyed to the secondary transfer area. Then, the toner image transferred to the intermediate transfer belt 10 is transferred to the sheet in the secondary transfer area. When the sheet bearing the toner image passes the fixing device 13, the toner image is fixed on the sheet. Thereafter, the sheet is discharged to the outside of the image forming apparatus 100.

Figure 4:
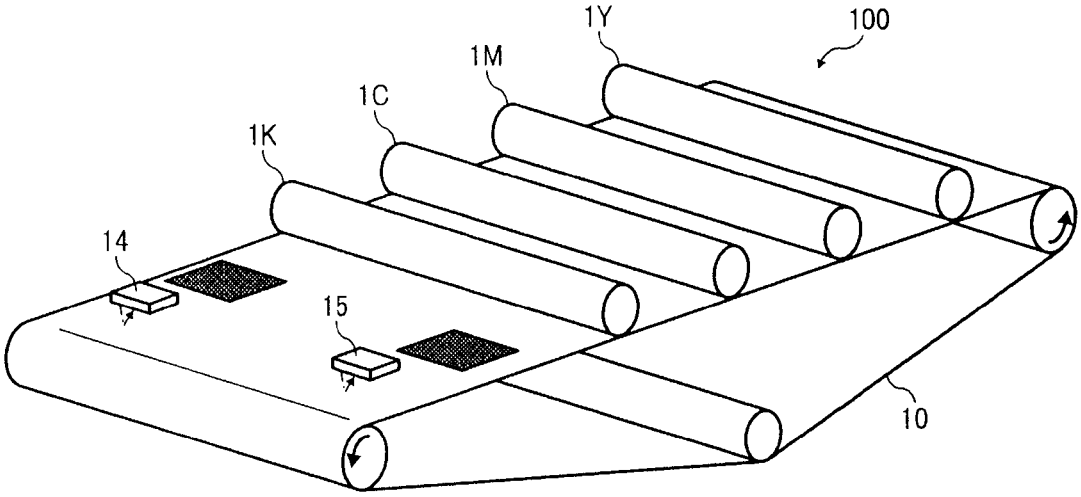
FIG. 4 is a schematic perspective view of an intermediate transfer belt and a toner density sensor included in the image forming apparatus shown in FIG. 3.

Referring to FIGS. 4, 5, 6A, and 6B, a description is now given of a structure and an operation of a toner density sensor. FIG. 4 is a perspective view of the intermediate transfer belt 10 and the photoconductors 1Y, 1M, 1C, and 1K. The image forming apparatus 100 further includes toner density sensors 14 and 15.

Figure 5:
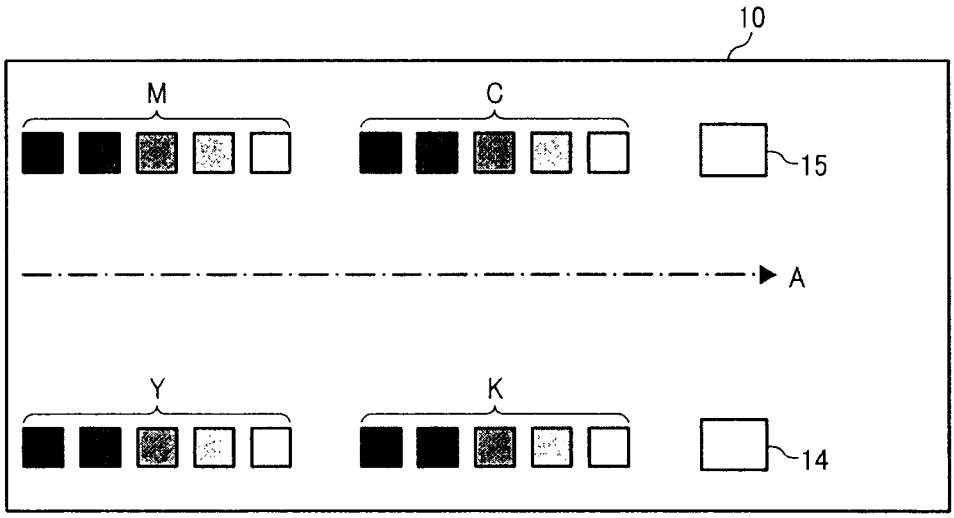
FIG. 5 is a top view of the intermediate transfer belt shown in FIG. 4.

FIG. 5 is a top view of the intermediate transfer belt 10. As illustrated in FIGS. 4 and 5, the toner density sensors 14 and 15, serving as internal information detector, are provided above the intermediate transfer belt 10 to oppose the outer circumferential surface of the intermediate transfer belt 10, and detect density of a toner pattern formed on the intermediate transfer belt 10.

Figure 6A:
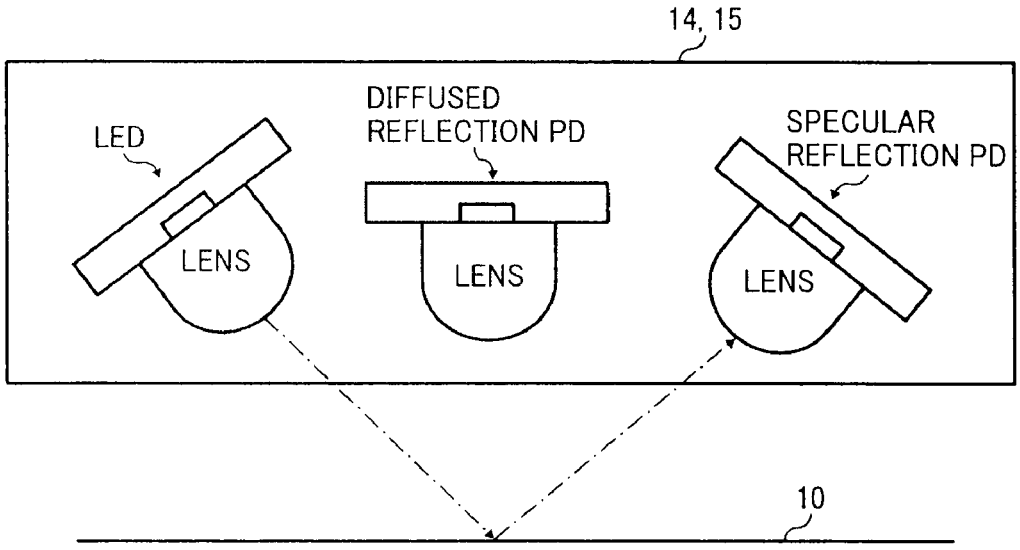
FIG. 6A is a schematic sectional view of the toner density sensor shown in FIG. 5.
Figure 6B:
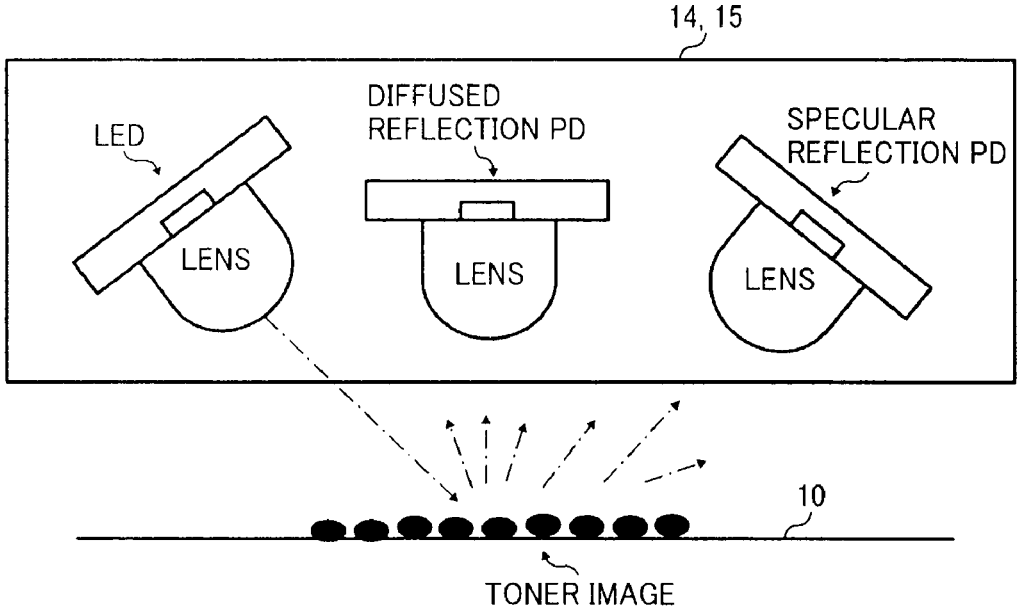
FIG. 6B is a schematic sectional view of the toner density sensor shown in FIG. 5.

FIG. 6A and FIG. 6B are schematic sectional view of the toner density sensor 14 (15) and the intermediate transfer belt 10. The toner density sensor 14 (15) is a reflective optical sensor and includes one LED (light-emitting diode) as a light-emitting element and two PDs (photodiodes) as light-receiving elements. One of the PDs is a specular reflection PD disposed in a position for receiving a specular light, while the other is a diffused reflection PD receiving a diffused reflected light at a position other than the position for receiving the specular light. As illustrated in FIGS. 4 and 5, the toner density sensors 14 and 15 are provided at both ends on the outer circumferential surface of the intermediate transfer belt 10 in a width direction of the intermediate transfer belt 10 and oppose each other. Alternatively, the toner density sensors 14 and 15 may be provided in a path for conveying the sheet after passing the secondary transfer area to detect density of a toner image formed on the sheet.

In order to prevent fixation of toner, the intermediate transfer belt 10 has a smooth glossy surface made of a material such as PVDF (polyvinylidene fluoride), polyimide or the like. Yellow, magenta, cyan, and black toner patterns having five density differences are properly sequentially formed on the intermediate transfer belt 10, as illustrated in FIG. 5. To be specific, in usual image formation, electrostatic latent images having the respective color toner patterns with five density differences are formed on the photoconductors 1Y, 1M, 1C, and 1K, respectively. After development by the development devices 3Y, 3M, 3C, and 3K, the electrostatic latent images are transferred to different positions on the intermediate transfer belt 10. As the intermediate transfer belt 10 moves in the direction A, each toner pattern with five density differences carried by the intermediate transfer belt 10 passes through a position opposing the toner density sensors 14 and 15. During this process, the toner density sensors 14 and 15 receive a reflected light from each toner pattern and output a detected signal according to the toner density of each toner pattern.

Figure 7:
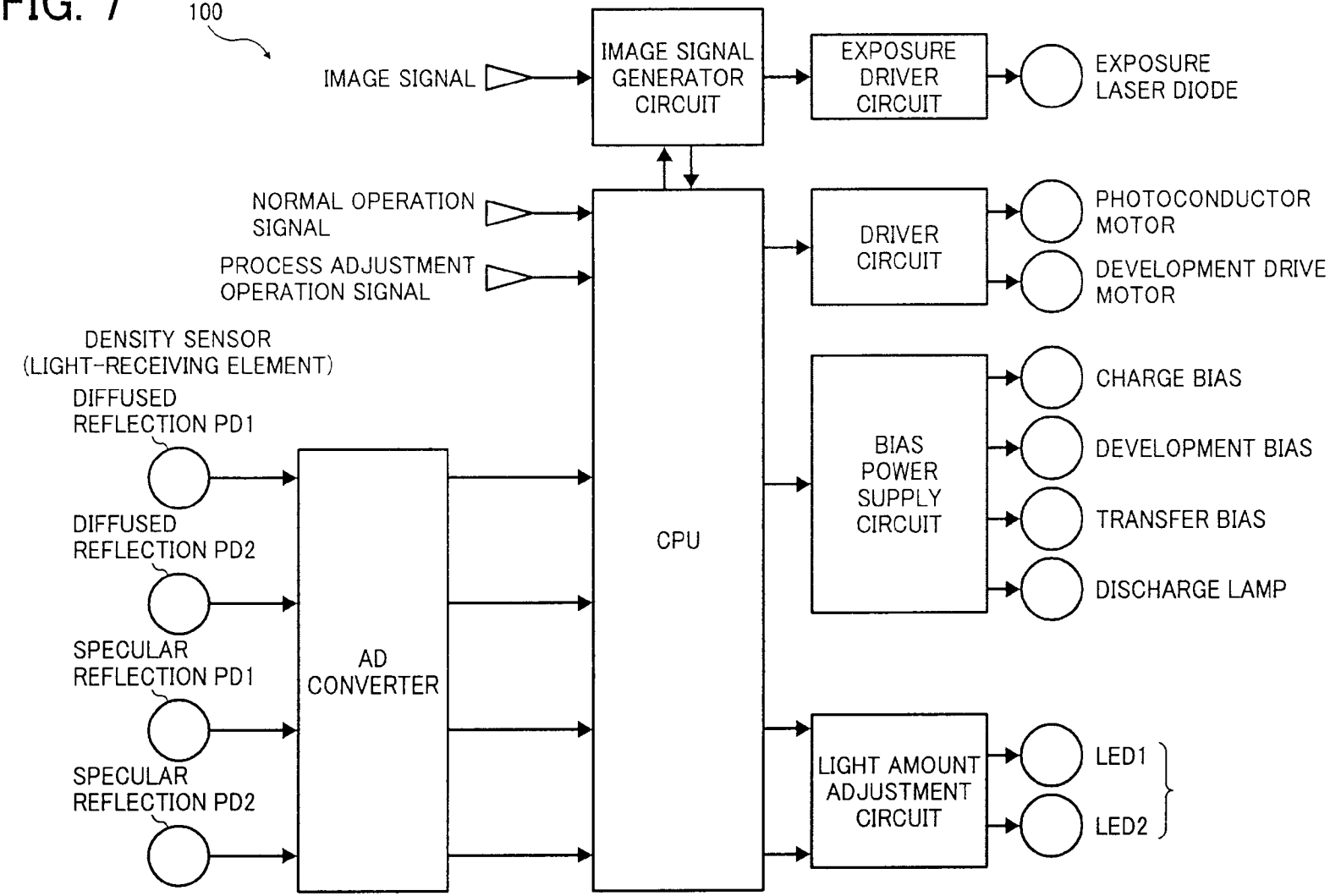
FIG. 7 is a schematic diagram of a control system of the image forming apparatus shown in FIG. 3.

Referring to FIG. 7, a description is now given of a control system of a process control (process adjustment operation) based on the detection signals of the toner density sensors 14 and 15. FIG. 7 is a block diagram of the control system of the image forming apparatus 100.

When the controller 9 depicted in FIG. 3 transmits a normal operation signal, an image signal generator circuit activates to order an exposure driver circuit to turn on and off a laser diode of the exposure devices 5Y, 5M, 5C, and 5K based on an image signal. A CPU (central processing unit), serving as a processor, orders a driver circuit to operate a driver system such as a photoconductor motor, a development drive motor and the like, and orders a bias power supply circuit to sequentially output a charge bias, development bias and the like, to perform image formation. In the electrophotographic image forming apparatus 100, an image density tends to fluctuate due to deterioration over time and environmental changes. Therefore, in order to keep a stable image density, the toner density sensors 14 and 15 depicted in FIG. 4 or other process control sensor perform the process adjustment operation.

Figure 8:
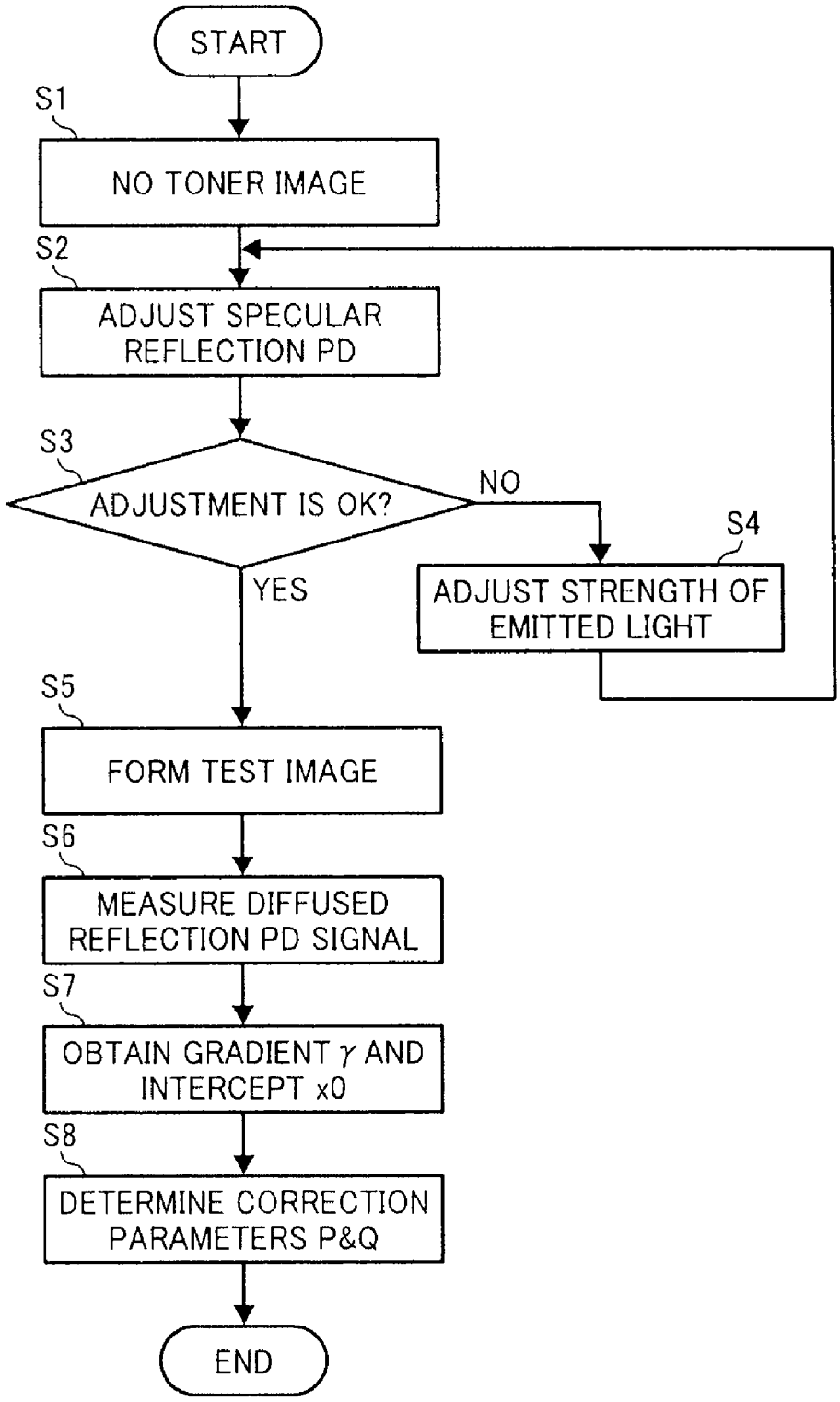
FIG. 8 is a flowchart of process control (process adjustment operation) performed by the control system shown in FIG. 7.
Figure 9A:
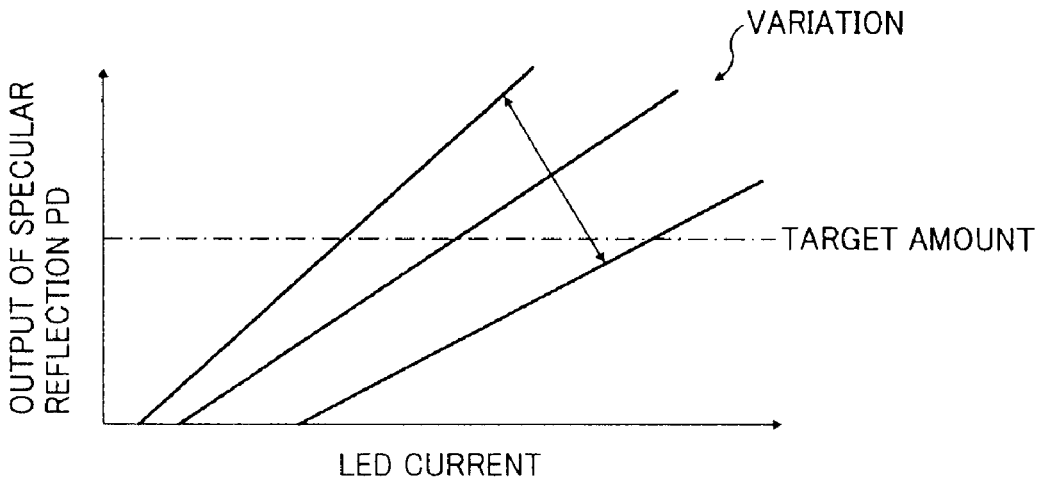
FIG. 9A is a graph illustrating a relation between output of a specular reflection PD and an amount of LED current.
Figure 9B:
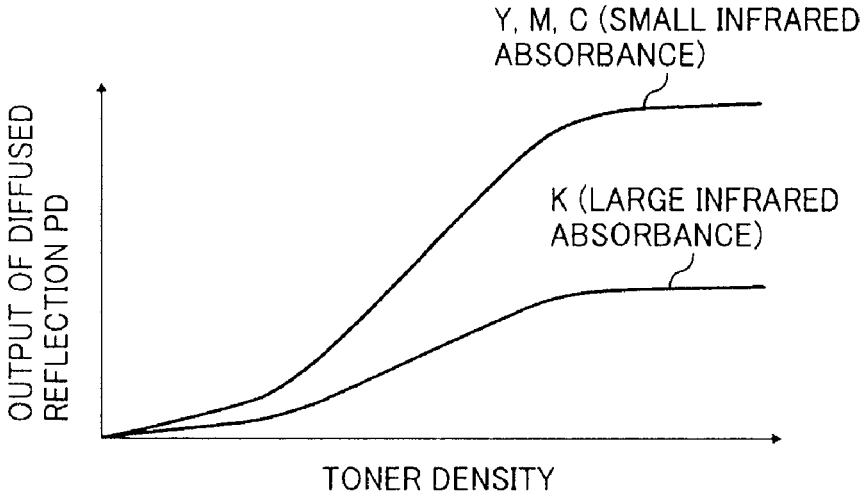
FIG. 9B is a graph illustrating a relation between output of a diffused reflection PD and toner density.
Figure 10:
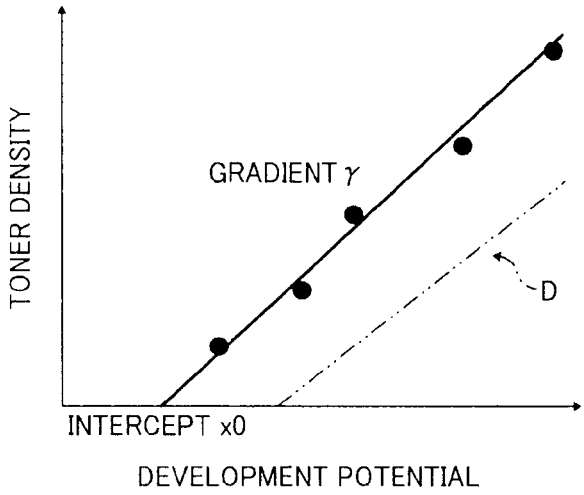
FIG. 10 is a graph illustrating a relation between a measurement result of density of a toner pattern and development potential.

Referring to FIGS. 8, 9A, 9B, and 10, a further detailed description is given of the process control (process adjustment operation). FIG. 8 is a flowchart thereof. FIG. 9A is a graph illustrating a relation between output of a specular reflection PD and an amount of LED current. FIG. 9B is a graph illustrating a relation between output of a diffused reflection PD and toner density. FIG. 10 is a graph illustrating a relation between a measurement result of density of a toner pattern and development potential.

When the controller 6 depicted in FIG. 3 transmits a process adjustment operation signal depicted in FIG. 7, or when the CPU depicted in FIG. 7 determines that the CPU receives a normal operation signal or when the CPU determines that image formation is performed based on the normal operation signal, the image forming apparatus 100 starts a process adjustment operation. In the process adjustment operation, the toner density sensors 14 and 15 initially perform a correction operation. In the correction operation, in step S1, as illustrated in FIG. 8, the image signal generator circuit depicted in FIG. 7 determines no image information to cause no toner to exist on the photoconductors 1Y, 1M, 1C, and 1K and the intermediate transfer belt 10. In steps S2, S3, and S4, the CPU orders adjustment of the amount of light of the toner density sensors 14 and 15 such that the specular reflection PD of the toner density sensors 14 and 15 outputs a predetermined target amount of received light as indicated by dotted line of FIG. 9A when no toner patterns exist on the intermediate transfer belt 10. Therefore, the toner density sensors 14 and 15 can stably detect toner density without being affected by a difference in performance or deterioration of the light-emitting element LED and the light-receiving element PD, a temporal change of a condition of each surface of the photoconductors 1Y, 1M, 1C, and 1K or the like.

In steps S5 and S6, when the image forming apparatus 100 automatically forms a test image of a predetermined toner pattern, as illustrated in FIG. 5, the toner density sensors 14 and 15 detect a toner pattern corresponding to the test image. It is to be noted that an image formation condition such as a charging bias condition or a development bias condition uses a predetermined specific value. In detection of density of the toner pattern, an output of the diffused reflection PD of the toner density sensors 14 and 15 is used. Therefore, as illustrated in FIG. 9B, a density of the toner pattern can be grasped from the output value of the diffused reflection PD. Since each toner includes a coloring agent of each color, the light-emitting element of the toner density sensors 14 and 15 preferably uses a near-infrared or infrared light source with a wavelength of about 840 nm that is little affected by the coloring agent. However, since typical black toner uses a low-cost carbon black and significantly absorbs light of an infrared area, as illustrated in FIG. 9B, compared to the other colors, the black toner has a decreased sensitivity to toner density.

According to this illustrative embodiment, since the toner density sensors 14 and 15 output a measurement result of each color toner pattern having five different densities, as illustrated in FIG. 10, a line of a development potential and a toner density (a characteristic line) that is linearly approximated based on five points of the measurement result of toner density of each color is obtained, in step S7, as illustrated in FIG. 8. The graph of FIG. 10 shows that a gradient γ and an intercept x0 of the characteristic line deviates from a desired characteristic D. In step S8, the gradient γ is corrected by multiplication of an exposed light amount correction parameter P by an exposure signal, and deviation of the intercept x0 is corrected by multiplication of a development bias by a correction parameter Q, thereby stably detecting image density. According to this illustrative embodiment, correction of the exposed light amount and the development bias is described. However, other process control value such as a charge bias, a transfer bias or the like, that contributes to image density can be corrected.

It is no be noted that the above-described process control is performed for correction of variations in the amount of charged toner due to temperature and humidity or variations of sensitivity of the photoconductors 1Y, 1M, 1C, and 1K in a normal state. However, internal information on output values of the toner density sensors 14 and 15 used for the process control may vary depending on occurrence of a specific kind of failure or even a possibility of the failure.

Figure 11A:
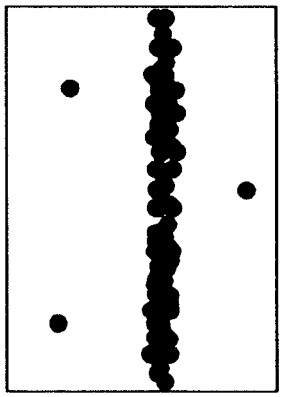
FIG. 11A is an illustration of a minute amount of background soiling occurring in a normal condition.
Figure 11B:
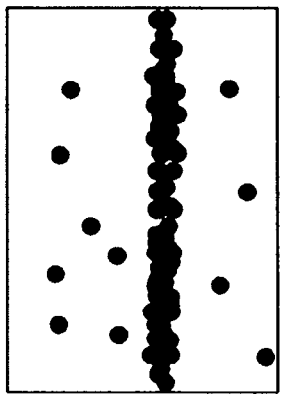
FIG. 11B is an illustration of a mild degree of background soiling.

Referring to FIGS. 11A, 11B, 12A, and 12B, a description is given of one example of such failure. FIG. 11A illustrates a minute amount of background soiling occurring in a normal condition. FIG. 11B illustrates a mild degree of background soiling.

The cleaners 4Y, 4M, 4C, and 4K depicted in FIG. 3 collect residual toner remaining on the photoconductors 1Y, 1M, 1C, and 1K after transfer, so as to prepare for subsequent charge and exposure processes. For example, the cleaners 4Y, 4M, 4C, and 4K use a blade cleaning method of scraping each surface of the photoconductors 1Y, 1M, 1C, and 1K with an urethane rubber blade. Thus, one part of toner particles may slip into a gap between the cleaning blade and each surface of the photoconductors 1Y, 1M, 1C, and 1K and pass through a cleaning area. Although many of the toner particles passes a charge and exposure area, that is, the charging devices 2Y, 2M, 2C, and 2K depicted in FIG. 3 and electrostatically collected by the development devices 3Y, 3M, 3C, and 3K, some toner particles is not collected by the development devices 3Y, 3M, 3C, and 3K due to loss of a charging characteristic or a change of shape caused by friction by the cleaning blade. Such toner non-electrostatically transfers to the intermediate transfer belt 10 regardless of whether an imaging area or non-imaging area, thereby transferring to a printed sheet. As a result, as illustrated in FIGS. 11A and 11B, toner may adhere to a non-imaging area of the sheet, causing background soiling.

A minute amount of toner particles adhering to a non-imaging area, as illustrated in FIG. 11A, is within an acceptable range, that is, in a normal state, since image quality is not significantly degraded. However, when the cleaning blade is worn due to long-time use, the cleaning blade decreases in scraping force, thereby gradually increasing the amount of toner passing the cleaning area. Then, a large amount of toner caught by the top of the cleaning blade in a portion in an axial direction of the photoconductors 1Y, 1M, 1C, and 1K gets over the cleaning blade and passes through the cleaning area. When this occurs, due to adhesion of the toner particles, the charging devices 2Y, 2M, 2C, and 2K significantly decrease its charging ability, and the exposure devices 5Y, 5M, 5C, and 5K cannot form desired electrostatic latent images on the surfaces of the photoconductors 1Y, 1M, 1C, and 1K. The development devices 3Y, 3M, 3C, and 3K cannot collect the large amount of toner particles. As a result, a faulty image with vertical streak lines is generated in the printed sheet where the large amount of toner gets over the cleaning blade, so that the image forming apparatus 100 falls into a malfunction condition that needs immediate repairing.

Shortly before reaching such malfunction condition, as illustrated in FIG. 11B, the greater amount of toner particles substantially equally adhere to the whole image area to cause the greater amount of background soiling than in the normal state. However, since image quality is not significantly degraded, a user rarely becomes aware of an abnormality, called a mild degree of background soiling, that is considered as a predictive state of a failure of the cleaning blade.

Figure 12A:
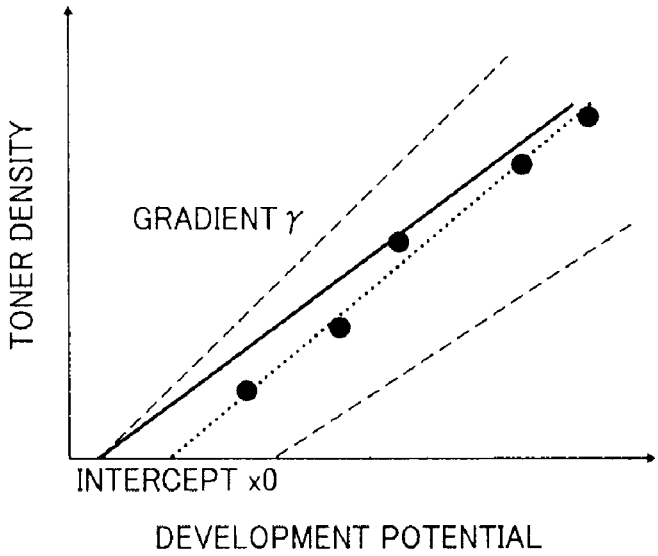
FIG. 12A is a graph illustrating a characteristic line in a mild degree of background soiling.
Figure 12B:
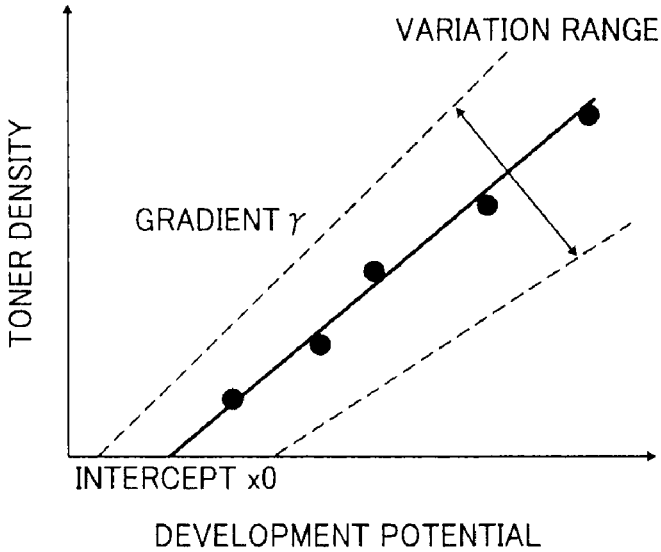
FIG. 12B is a graph illustrating a characteristic line according to an environmental change.

FIG. 12A is a graph illustrating a characteristic line in a mild degree of background soiling, and FIG. 12B is a graph illustrating a characteristic line according to an environmental change. The mild degree of background soiling causes the toner density sensors 14 and 15 to output a high density value from measurement of a low density portion of a toner image, as illustrated in FIG. 12A. Therefore, both gradient γ and intercept x0 of the characteristic line slightly decrease. However, such changes in the characteristic line of FIG. 12A due to the mild degree of background soiling is not greatly different from a change in the characteristic line due to environmental and temporal changes of FIG. 12B. It is difficult to detect generation of the mild degree of background soiling based on variations of the gradient γ and the intercept x0 of the characteristic line of a single color toner or variations of the correction parameters P and Q determined based on the variations of the gradient γ and the intercept x0, thereby making it difficult to precisely predict a failure of the cleaning blade. Therefore, a conventional image forming apparatus reports a possibility of a failure of a cleaning blade merely when the cleaning blade is obviously in an abnormal condition, and thus, it can hardly deal with a probable failure before its occurrence.

Figure 13:
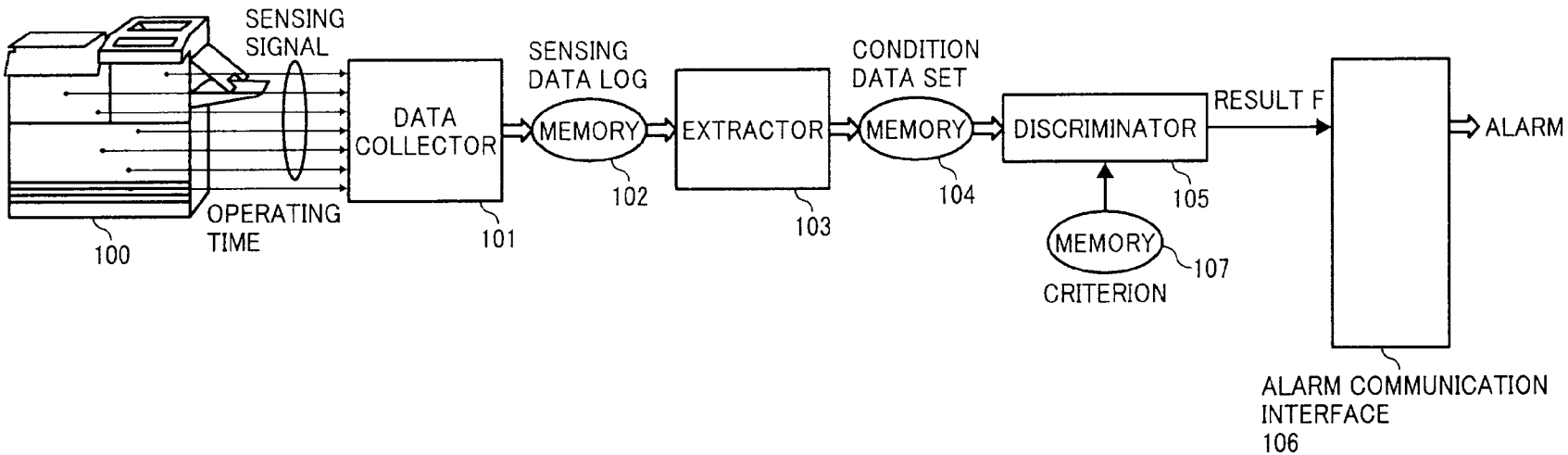
FIG. 13 is a diagram of a process of outputting a prediction of occurrence of a fault in a black toner cleaning blade of a photoconductor included in the image forming apparatus shown in FIG. 3.
Figure 14:
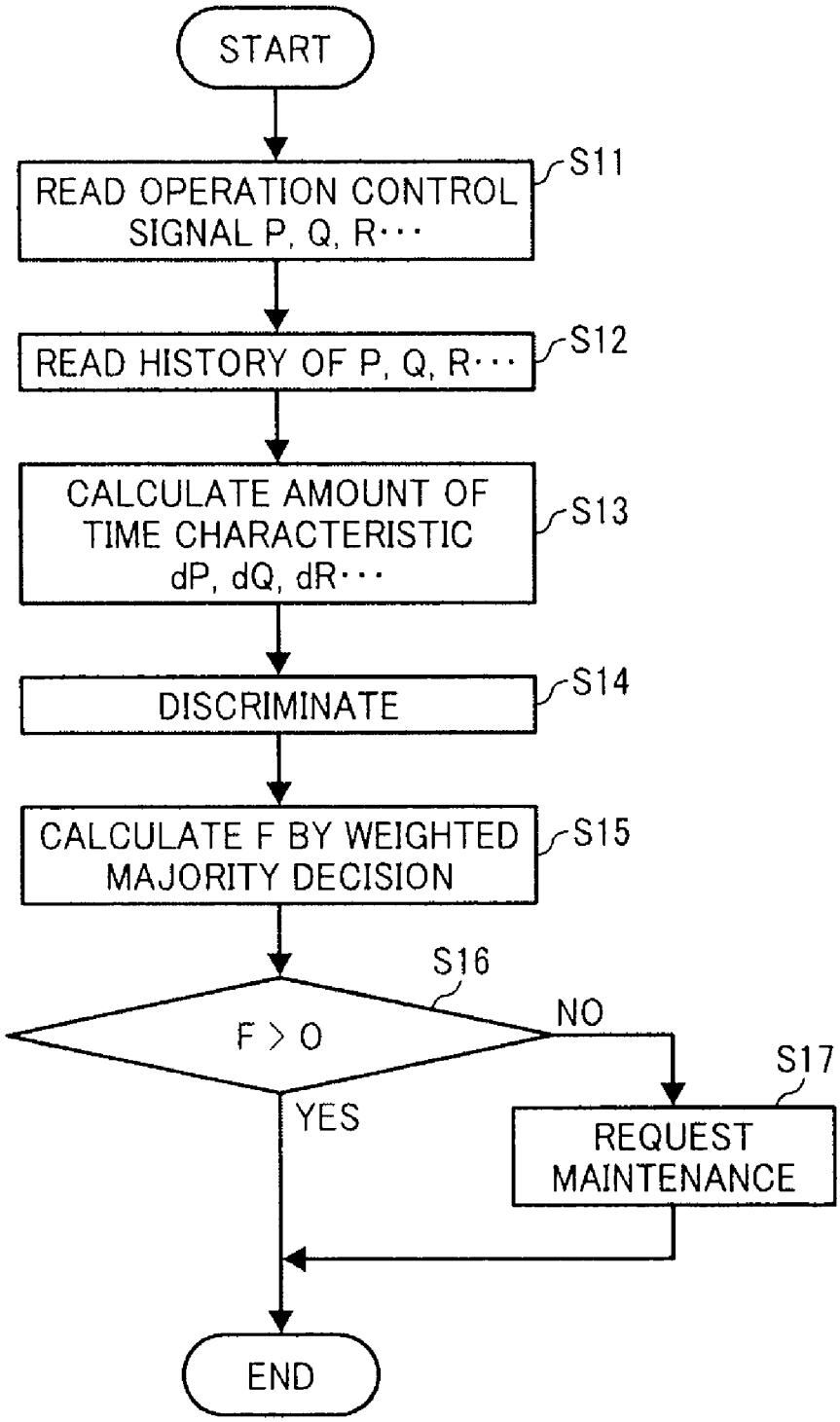
FIG. 14 is a flowchart showing steps in the outputting process shown in FIG. 13.
Figure 15:
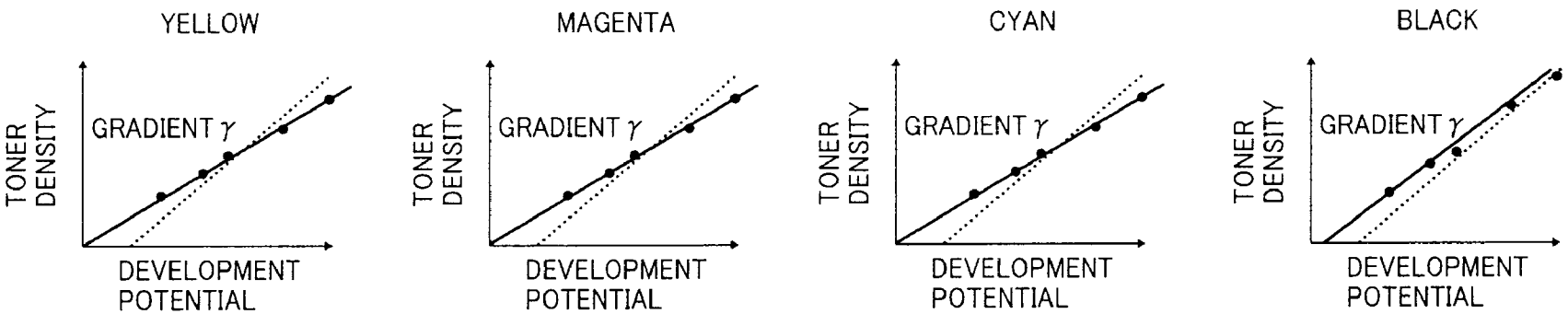
FIG. 15 shows graphs illustrating characteristic lines of respective color toner.
Figure 16:
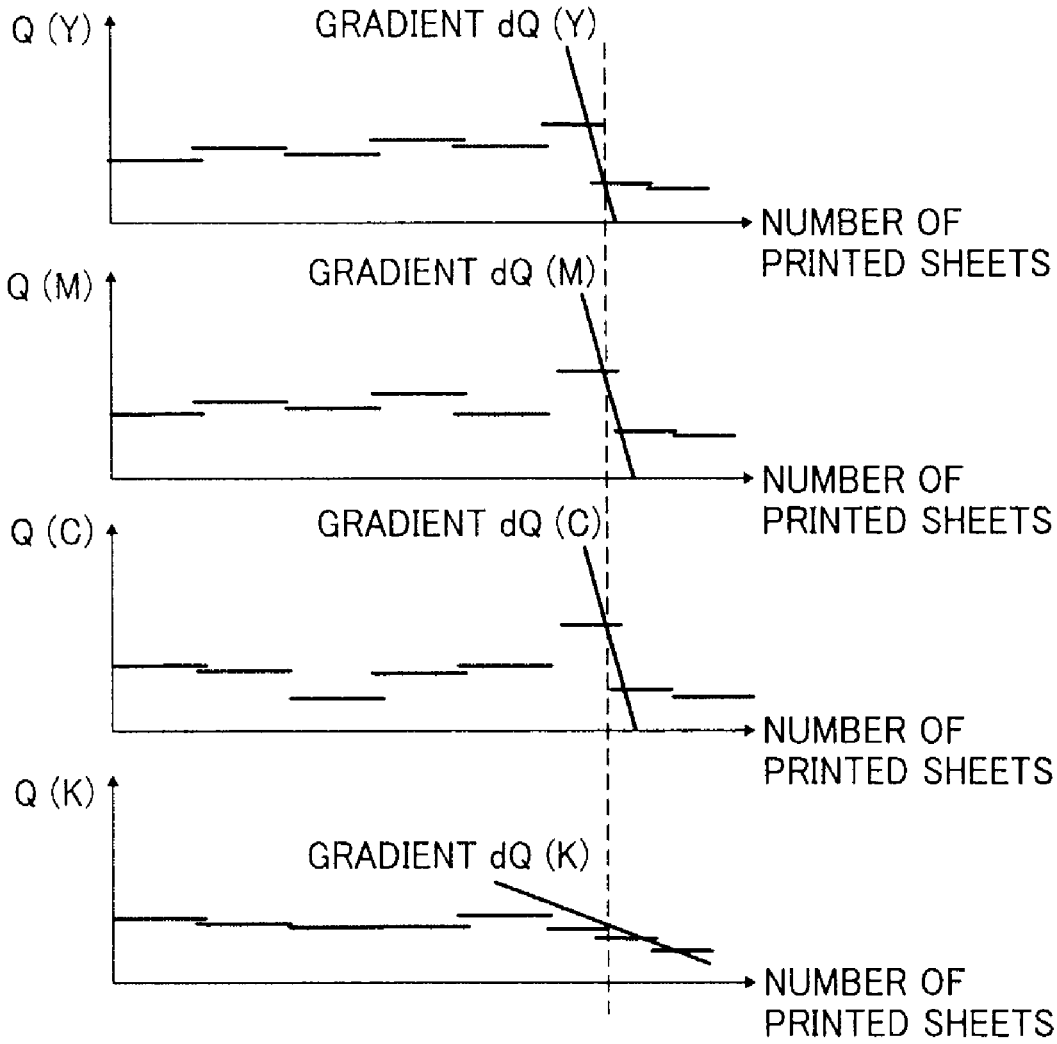
FIG. 16 shows graphs illustrating temporal changes in the correction parameter.

Referring to FIGS. 13, 14, 15, and 16, a description is now given of a process of reporting a possibility of a fault in a cleaning blade. FIG. 13 is a diagram of the process of providing a prediction of a fault in a black toner cleaning blade of the photoconductor 1K, and FIG. 14 is a flowchart showing steps in that process. FIG. 15 shows graphs illustrating characteristic lines of the respective color toner obtained by the process control performed by the CPU depicted in FIG. 7. FIG. 16 shows graphs illustrating temporal changes in the correction parameter Q.

According to this illustrative embodiment, the CPU depicted in FIG. 7 detects an abnormality in the black toner cleaning blade of the photoconductor 1K based on the correction parameters P and Q obtained from the detection signals from the toner density sensors 14 and 15 of the image forming apparatus 100 depicted in FIG. 3 used as a sensing signal as internal information. According to this illustrative embodiment, abnormality includes both a failure state and a predictive failure state, that is, a deviation from a normal state in the image forming apparatus 100.

To be specific, as illustrated in FIG. 14, in step S11, when the CPU, serving as a processor, performs process control to calculate the correction parameters P and Q for each color, a data collector 101 depicted in FIG. 13, serving as an information collector, stores the correction parameters P and Q in a memory 102 depicted in FIG. 13 as a sensing data log. According to this illustrative embodiment, the data collector 101, serving as an information collector, is implemented by the CPU depicted in FIG. 7 and an accompanying memory device. Alternatively, the data collector 101 may be implemented by another CPU and a memory device connected to the CPU and capable of communicating with the CPU. For example, the controller 9 depicted in FIG. 3 performing overall control of the image forming apparatus 100 may implement the data collector 101, or a dedicated management device provided independently from the image forming apparatus 100 may be used as the data collector 101.

Subsequently, in steps S12 and S13, an extractor 103 depicted in FIG. 13 mathematically or statistically calculates whether or not an unusual change occurs in a past signal, creates a condition data set, and stores the condition data set in a memory 104 depicted in FIG. 13. The condition data set stored in the memory 104 is transmitted to a discriminator 105 depicted in FIG. 13. To be specific, when the characteristic line of each color toner of FIG. 15 is obtained by the process control, a log of the correction parameter Q is updated, as illustrated in FIG. 16. Then, a difference between a latest value Q and a previous value Q as the amount of time characteristic is divided by elapsed time or the amount of operating time, thereby obtaining an approximate derivative value dQ. The condition data set including the approximate derivative value dQ is stored in the memory 104.

Since time degradation of the image forming apparatus 100 depends on the amount of operating time, the difference between the latest value Q and the previous value Q of the amount of time characteristic is preferably divided by the amount of operating time as indicated for example by a counter value of a number of printed sheets rather than by the elapsed time. In this case, since the CPU manages the amount of operating time, the data collector 101 stores the amount of operating time as well as the sensing signal. Alternatively, an integrated value of the amount of operation, an amount of real time elapsed, or the like may be used.

It is to be noted that the amount of time characteristic extracted by the extractor 103 may be various kinds of amounts of characteristics, such as a regression value of a signal change, a standard deviation, a maximum amount, or an average amount of a plurality of pieces of data. There are many known methods of extracting the amount of characteristics of a time-series signal, such as an ARIMA (autoregressive moving average) model or the like. Since a possibility of a fault in the image forming apparatus 100 can be detected when the sensing signal (internal information) stabilized in a normal state becomes unstable in various forms, an appropriate method of extracting the amount of time characteristic can be selected.

Alternatively, an amount of characteristic not including temporal calculation may be added to the condition data set. For example, a value of the sensing signal at a given time may be added, or operation information on operating time or elapsed time may be added. Alternatively, a signal indicating performance of maintenance may be prepared and stored in the memory 102 depicted in FIG. 13 by being added to the sensing data log, and an exceptional treatment may be performed so as to avoid incorrect detection of a transitory change of the condition data set immediately after the maintenance as a predictive failure state.

The discriminator 105 depicted in FIG. 13 is implemented by the CPU executing a predetermined detection program and determines whether the condition data set is in a normal state or in a predictive failure state. It is appropriate for the extractor 103 and the discriminator 105 depicted in FIG. 13 to be implemented by the CPU executing a predetermined computer program rather than by hardware in terms of reduction of costs and a development period. The discriminator 105 includes a plurality of sub-discriminators prepared for each piece of the condition data. Referring back to FIG. 14, in step S14, each sub-discriminator individually determines whether or not each piece of the condition data (the amount of characteristic such as the approximate derivative value dQ) is in a normal state or in a predictive failure state. In step S15, the discriminator 105 obtains a value F as a calculation result by weighted majority decision. When the value F indicates a predictive failure state (NO at step S16), in step S17, an alarm communication interface 106 depicted in FIG. 13, serving as a communication interface, informs a user of the image forming apparatus 100 of the predictive failure state or informs an operator of the management device 200 depicted in FIG. 2 via the communication network.

Since the sub-discriminator of the discriminator 105 uses a stamp discriminator discriminating threshold magnitude, the CPU can perform calculations at high speed. In addition, due to use of the weighted majority decision, the discriminator 105 can precisely predict a fault in the image forming apparatus 100 at low cost.

A state discrimination calculation method when the sub-discriminator is the stamp discriminator is described.

A stamp discriminator is prepared for each of calculation results Cl to Cn of the amount of time characteristic of sensing signals P, Q, R, . . . n to obtain a value F as a calculation result by weighted majority decision based on a following formula (1):

$$F = \sum_{i=1}^{n} (\alpha i \times OUTi) \tag{1}$$

where $\alpha i$ represents a weighting coefficient given to each sub-discriminator, and OUTi represents a determination result of each sub-discriminator.

OUTi is represented by the following formula (2), when (Ci−bi) is greater than or equal to zero:

$$\mathrm{OUT}i=(\mathrm{sgn}i\times(Ci-bi)) \tag{2},$$

and when (Ci−bi) is smaller zero, OUTi is represented by the following formula (3):

$$\mathrm{OUT}i=-(\mathrm{sgn}i\times(Ci-bi)) \tag{3}$$

where bi represents a threshold value of each characteristic amount, and sgni represents determination polarity.

According to this illustrative embodiment, when the value F is smaller than zero (NO in step S16 in FIG. 14), the discriminator 105 identifies a predictive failure state.

It is to be noted that as the weighting coefficient $\alpha i$, the determination polarity sgni, and the threshold value bi being prediction criteria are determined from a result learned based on various types of sensing signals when the image forming apparatus 100 is in a test operation or in an actual operation. Such prediction criteria are stored in advance in a memory 107 depicted in FIG. 13, to which the discriminator 105 refers to detect a predictive failure state. For determination of the criteria αi, sgni, and bi, a supervised leaning algorithm called a boosting method, which appears in, for example, MATHEMACIAL SCIENCE No. 489, March 2004, titled "Information Geometry of Statistical Pattern Identification", published by SAIENSU-SHA CO., LTD. is used. To be specific, sensing log data of a normal state and sensing log data of a predictive failure state are prepared. For example, the latter sensing data log is recorded when an endurance test of the image forming apparatus 100 is performed, and a period of a predictive failure state of the image forming apparatus 100 is estimated before occurrence of the failure of the image forming apparatus 100, and the sensing log data during the period is used.

Figure 17:
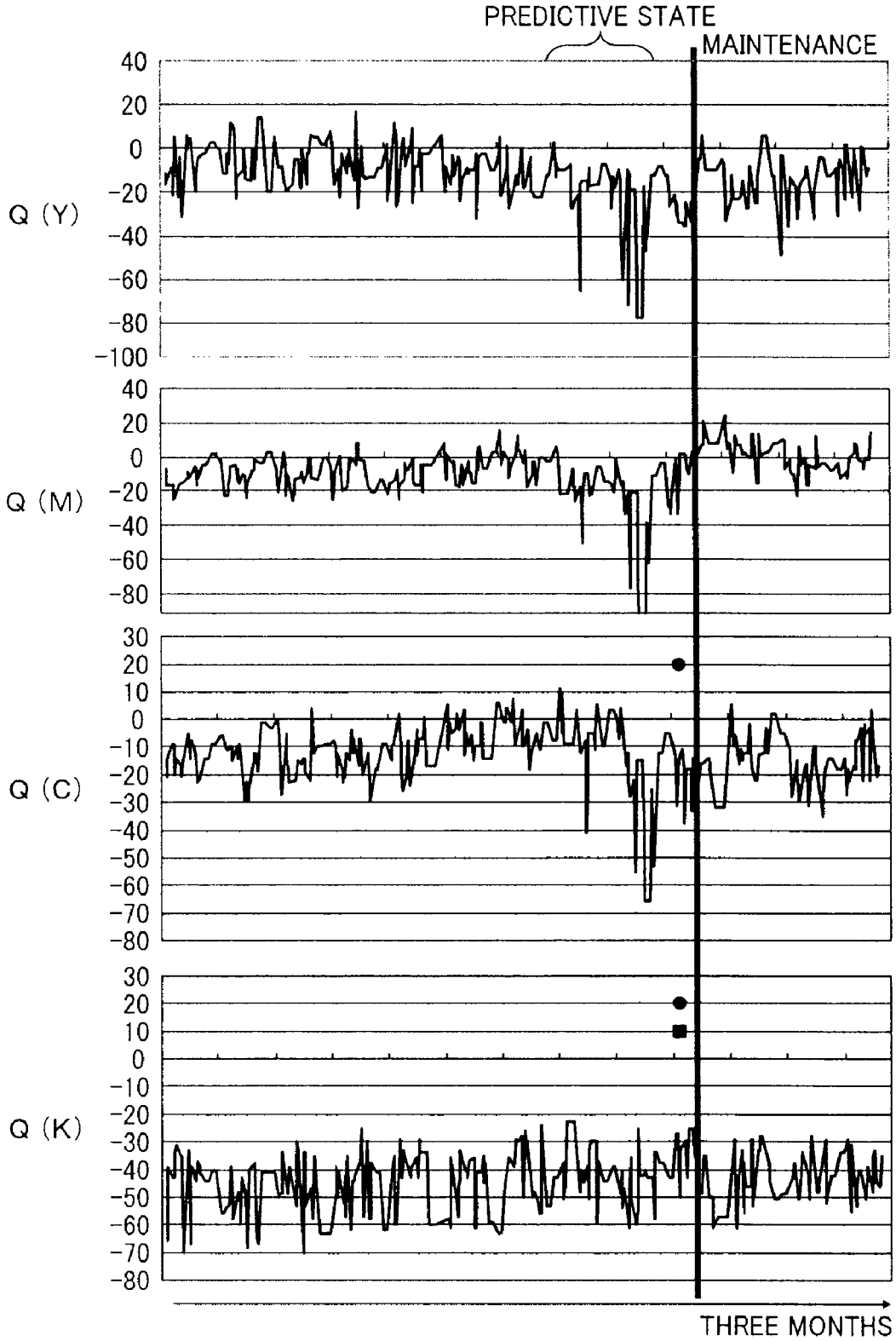
FIG. 17 shows graphs illustrating a temporal change of a correction parameter Q.
Figure 18:
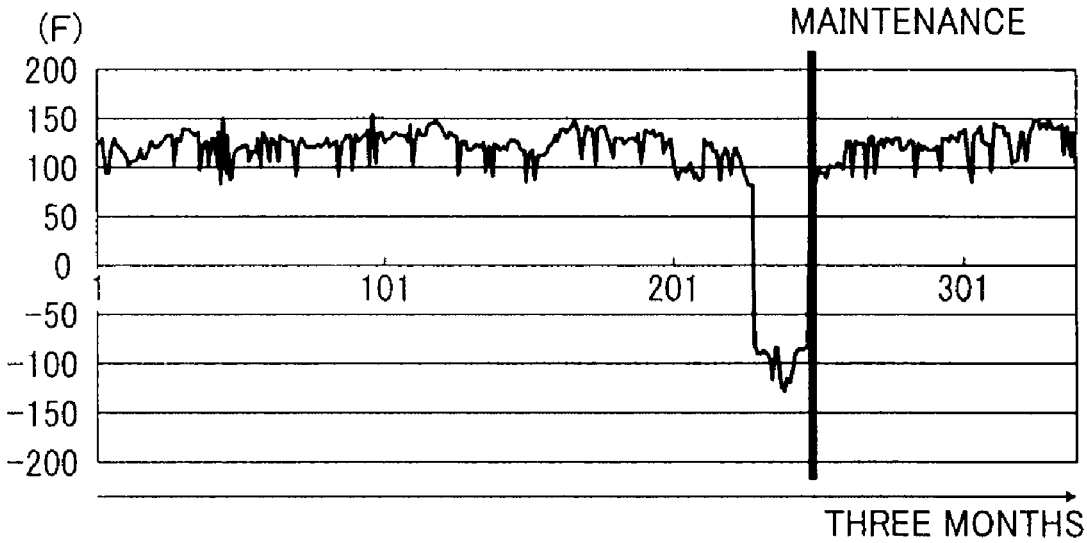
FIG. 18 is a graph illustrating a result of calculation of a value F.
Figure 19:
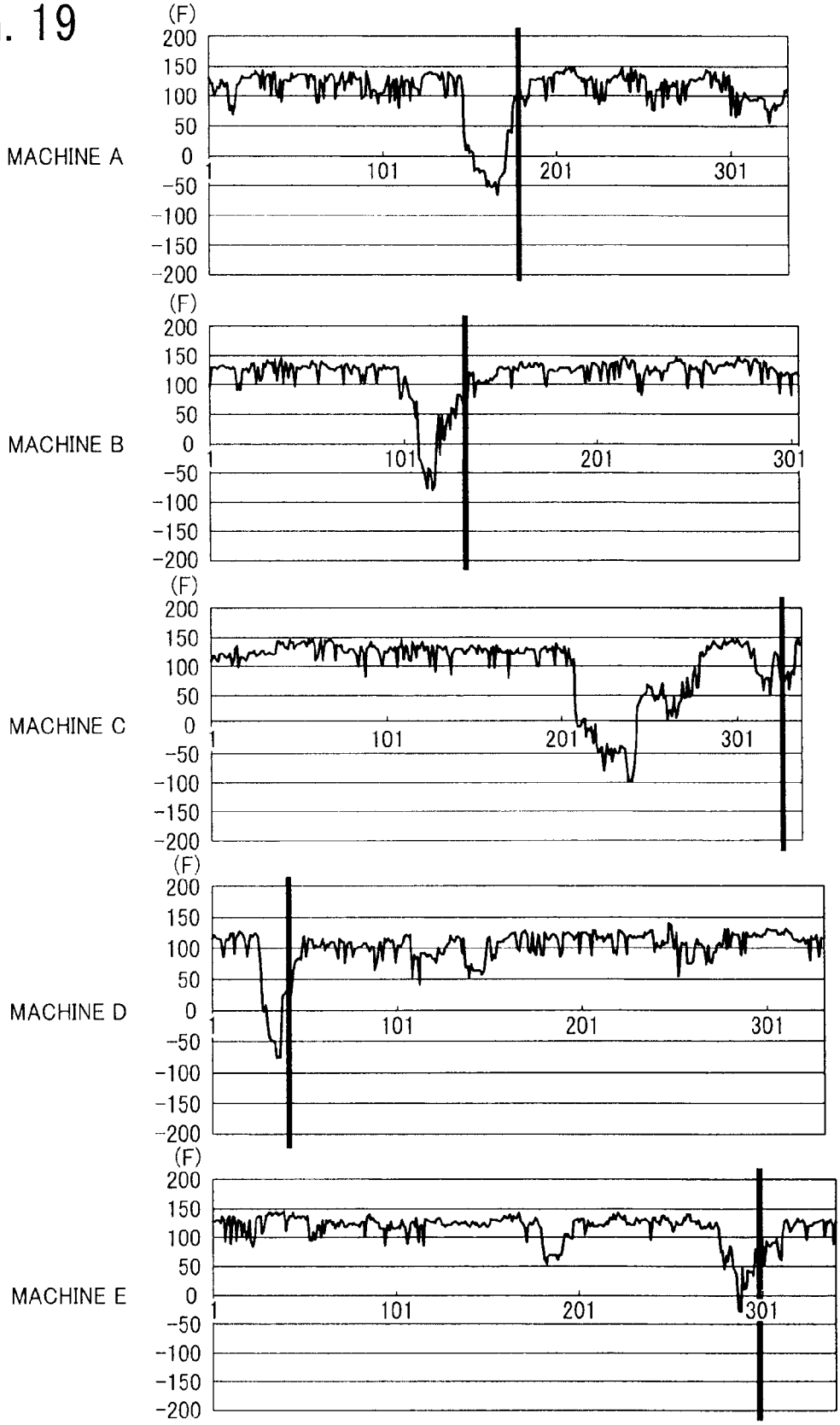
FIG. 19 shows graphs illustrating F values using a discriminator of five test machines.

Referring to FIGS. 17, 18, and 19, a description is now given of an experiment using more than 10 test machines of the image forming apparatus 100.

For three months of recording a sensing data log, the data collector 101 depicted in FIG. 13 collected cases of failures of the test machines. FIG. 17 shows graphs illustrating a temporal change of a correction parameter Q (value corresponding to the intercept x0 of FIG. 15) of each color in a case in which one of the test machines had a cleaning failure and formed a defective image with black streak lines. Although the data collector 101 collected many other pieces of internal information, the correction parameter Q having the most remarkable change is described. FIG. 17 shows that the correction parameters Q of yellow, magenta, and cyan toner vary before occurrence of the black toner cleaning failure. Then, the extractor 103 depicted in FIG. 13 extracted the amount of time characteristic of yellow, magenta, and cyan toner to generate a condition data set. When a predictive failure period was visually estimated, a label of a corresponding portion of the condition data set was −1 (predictive failure period) and a label other than the above was +1 (normal period), and a hundred times of repeated learning by the boosting method was performed to determine the criteria bi, sgni, and αi for the correction parameter Q.

FIG. 18 is a graph illustrating a result of calculation of a value F using data used for the repeated leaning. The graph shows that the discriminator 105 learned the labeled supervised data and output a value F declining to below zero in a predictive failure state.

Subsequently, by using the discriminator 105, verification of whether or not an appropriate result is obtained for the sensing log data not used for learning by creating a condition data set from the sensing log data of other test machines A, B, C, D, and E having black toner cleaning failure was performed. FIG. 19 shows graphs illustrating results thereof.

Each graph shows that the value F output from the discriminator 105 performing calculation based on the above-described criteria bi, sgni, and αi declines to below zero before occurrence of a black toner cleaning failure. Therefore, the value F below zero indicates a predictive state of a black toner cleaning failure. Since the data collector 101, serving as an information collector, continuously collects the correction parameter Q of the image forming apparatus 100 and the discriminator 105, serving as a device state discriminator, detects a predictive failure state, a user can replace and repair an image formation unit for black toner before occurrence of a defective image with vertical streaks, thereby preventing waste of resources due to formation of the same image again. Moreover, when such maintenance is performed when the image forming apparatus 100 is not working, downtime of the image forming apparatus 100 can be reduced.

Figure 20:
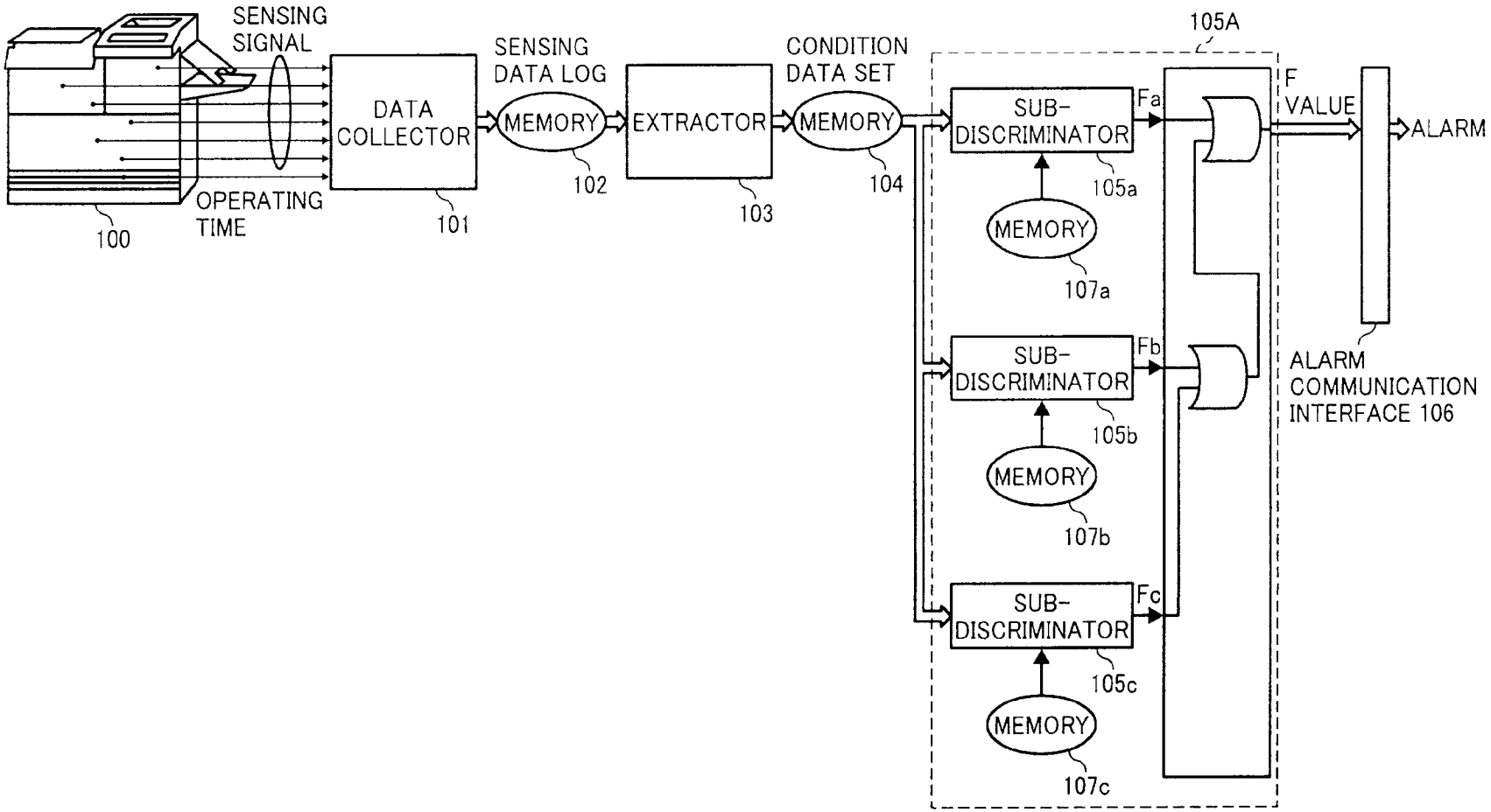
FIG. 20 is a schematic diagram of a modification of the outputting process shown in FIG. 13.

Referring to FIG. 20, a description is now given of a modification of the discriminator 105. Since magnitude, ratio, speed and the like of changes of the correction parameters Q of yellow, magenta, and cyan toner are different among test machines, the criteria bi, sgni, and αi are different depending on which test machine's sensing log data is used. Thus, a plurality of sub-discriminators using criteria bi, sgni, and αi generated by learning using sensing log data of a plurality of test machines may be provided to determine a black toner failure predictable state.

FIG. 20 is a schematic diagram of a process of predicting a fault in a cleaning blade using a discriminator 105A. The discriminator 105A includes three sub-discriminators 105*a*, 105*b*, and 105*c*. The sub-discriminators 105*a*, 105*b*, and 105*c* predict a black toner cleaning failure based on different criteria and output results Fa, Fb, and Fc, respectively. Based on the results Fa, Fb, and Fc, the discriminator 105A outputs a result value F. The sub-discriminators 105*a*, 105*b*, 105*c* provided in parallel need to precisely predict a failure, respectively.

Although the prediction criteria used by the sub-discriminators 105*a*, 105*b*, 105*c* can be created when data of an appropriate failure case is obtained, some appropriate failure cases are undetectable by an operation test during product development and can only be found from sensing data collected after the image forming apparatus 100 actually starts working. According to this illustrative embodiment, the management device 200 depicted in FIG. 2, serving as a criterion generator, collects the sensing data via the communication network from each image forming apparatus 100 after being delivered to a user and generates criteria used by the sub-discriminators 105*a*, 105*b*, 105*c* from the failure case. The sub-discriminators 105*a*, 105*b*, 105*c* using the criteria can be added to each image forming apparatus 100 from the management device 200 via the communication network.

As a method of adding the sub-discriminators 105*a*, 105*b*, 105*c*, for example, a prediction program for allowing the CPU depicted in FIG. 7 to function as the sub-discriminators 105*a*, 105*b*, 105*c* and prediction criteria are installed in each image forming apparatus 100 via the communication network. Alternatively, the sub-discriminators 105*a*, 105*b*, 105*c* predicting a fault in the image forming apparatus according to dummy criteria may be installed in advance in each image forming apparatus 100, and rewritten to new criteria via the communication network.

Figure 21:
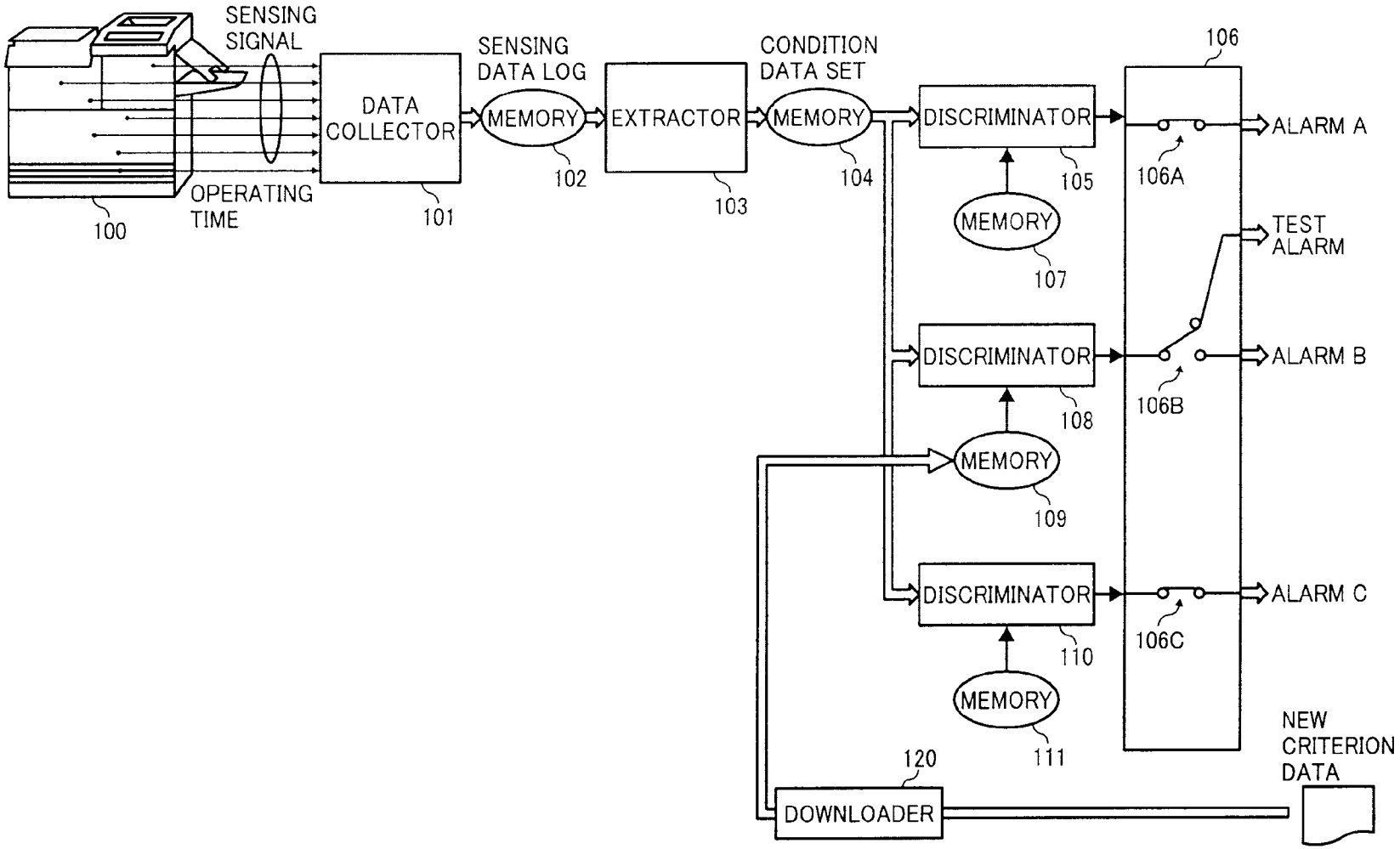
FIG. 21 is a schematic diagram of a process of outputting fault prediction using additional discriminators.

Referring to FIG. 21, a description is now given of a process for adding an additional discriminator predicting a fault different from the fault predicted by the discriminator 105, as described above. FIG. 21 is a schematic diagram thereof.

The image forming apparatus 100 further includes a discriminator 108 and a discriminator 110. The alarm communication interface 106 includes switches 106A, 106B, and 106C. The discriminator 108 predicts a magenta toner cleaning failure. The discriminator 110 predicts a cyan toner cleaning failure. However, since the image forming apparatus 100 in a development stage cannot obtain prediction criteria for precisely defining a deviation from a normal state of magenta and cyan toner cleaning blades, each of memories 109 and 111 of the discriminators 108 and 110 stores dummy criteria. Each of the discriminators 108 and 110 neither predicts a cleaning failure based on the dummy criteria nor outputs a prediction result indicating a failure of the magenta and cyan toner cleaning blades.

According to this illustrative embodiment, the management device 200 depicted in FIG. 2 periodically collects internal information on sensing data or the like from each image forming apparatus 100 delivered to a user. When the management device 200 confirms that the image forming apparatus 100 in working condition has a magenta toner cleaning failure, the management device 200 estimates a period of a predictable state before the occurrence of the cleaning failure and analyzes sensing log data during that period to determine whether or not to generate prediction criteria (internal information used for prediction, a coefficient and a threshold value used for prediction, and the like) by which the magenta toner cleaning failure is precisely predicted. When determining to generate prediction criteria, the management device 200, serving as a criterion generator, generates new criteria from the sensing log data. The management device 200 transmits the generated criteria to each image forming apparatus 100 via the communication network. Then, a downloader 120, serving as a criterion incorporator, rewrites the dummy criteria stored in the memory 109, serving as an input receiver, to be updated to the criteria generated by the management device 200. Therefore, the discriminator 108 predicts a magenta toner cleaning failure according to the criteria. As a result, when the discriminator 108 outputs a prediction result indicating a failure state, the alarm communication interface 106 reports a possibility of the magenta toner cleaning failure in a way different from when the black toner cleaning failure is reported.

According to this illustrative embodiment, the image forming apparatus 100 can report the predictable state of magenta toner cleaning failure. Thus, as with the black toner cleaning failure, before occurrence of a defective image with magenta streaks, an image formation unit for magenta toner can be replaced and repaired, thereby preventing waste of resources due to formation of an extra image instead of the defective image. Moreover, since such maintenance is performed when the image forming apparatus 100 is not working, downtime of the image forming apparatus 100 can be reduced.

When the discriminators 105, 108, and 110 often erroneously predict a cleaning failure due to a low degree of precision, the CPU depicted in FIG. 7 selectively turns on and off the switches 106A, 106B, and 106C to stop operation of the discriminators 105, 108, and 110. Therefore, in case of frequent erroneous prediction, by turning off the switches 106A, 106B, and 106C based on a command input by a user or based on instruction information transmitted from the management device 200 via the communication network, the image forming apparatus 100 can prevent such erroneous detection.

Alternatively, the discriminators 105, 108, and 110 may not output a prediction result indicating a predictable failure state. To be specific, the prediction criteria of the discriminators 105, 108, and 110 can be easily replaced by the dummy criteria via the communication network.

Moreover, such frequent erroneous prediction occurs due to occurrence of a condition different from learning data, which is caused by a difference in characteristic of each image forming apparatus 100 or an environmental difference in operational condition, temperature, humidity, and the like. Therefore, even though new criteria are generated after careful testing, it is desirable to confirm whether or not each image forming apparatus 100 precisely works using the criteria.

Therefore, according to this illustrative embodiment, until a predetermined condition is satisfied, a prediction result of the discriminator 108 using the criteria is reported to a user as a test alarm by the switch 106B. As a result, the image forming apparatus 100 can perform a trial operation of the discriminator 108 before the discriminator 108 starts working, thereby preventing unnecessary maintenance due to frequent erroneous prediction. As a test alarm communication device, for example, a liquid crystal control panel, an operation key, an indicator lamp or the like of the image forming apparatus 100 can be used. Alternatively, a device for reporting the test alarm to the management device 200 via the communication network may be used. Therefore, when receiving the test alarm, a user of the image forming apparatus 100 can confirm a possibility of a failure of the image forming apparatus 100 by checking the image forming apparatus 100 and printing a test image, or by encountering a fault in the image forming apparatus 100, the user can actually confirm that the discriminator 108 properly predict a fault in the image forming apparatus 100. When the user confirms that the discriminator 108 properly predict a fault in the image forming apparatus 100, the user operates a control panel of the image forming apparatus 100 to allow the discriminator 108 to formally warn about the possibility of a fault, so that the switch 106B outputs a formal alarm B.

Although it is desirable to precisely determine whether or not the discriminator 108 outputs a proper prediction by testing performance of the discriminator 108 for a long period of time, the discriminator 108 cannot be effectively utilized. Therefore, when a test period indicated by a manager of the management device 200 elapses, the switch 106B can formally inform a user of the alarm B. Since the manager of the management device 200 can get a history of usage of the discriminator 108 by many image forming apparatuses 100, the manager can set an appropriate test period.

Although the manager of the management device 200 can easily know a statistical fault and maintenance information of many image forming apparatuses 100, the manager hardly knows detailed information on operating or environmental conditions or the like of each image forming apparatus 100. Thus, the manager can confirm correctness of fault predictions by the discriminators 105, 108, and 110, but cannot expect an inappropriate result of prediction depending on differences among the discriminators 105, 108, and 110, or characteristics of the image forming apparatus 100. However, since a user of the image forming apparatus 100 precisely knows an operation condition, an environmental condition and the like, of the image forming apparatus 100, the user can inspect a condition of the image forming apparatus 100, an output image, and the like. Therefore, by adding an additional discriminator or selecting a discriminator, the user can effectively exclude an inappropriate discriminator peculiar to each image forming apparatus 100. Thus, the user can operate the switch 106B by using the control panel of the image forming apparatus 100.

Moreover, since the manager (provider of the additional discriminator) of the management device 200 does not know an environmental condition of the image forming apparatus 100, it is important for the manager to get feedback of a test result from the user of the image forming apparatus 100 in order to generate a discriminator having a high degree of precision. In this case, for example, the manager provides the user with the additional discriminator together with an operational condition and an environmental condition appropriate for the discriminator, thereby allowing the user to properly choose a useful discriminator.

As a method of transmitting feedback of a test result to the manager of the management device 200, a commonly-used communication method such as e-mail or the like can be used. Alternatively, however, in order to transmit precise information, a following method is preferable. The image forming apparatus 100 stores an operation record from when the user adds a new discriminator 108 to when the discriminator 108 is tested and judged as being acceptable and connected to an alarm, or to when the discriminator 108 is judged as being unacceptable and deleted or unconnected to the alarm. Then, in connection or deletion of the alarm, the stored information is transmitted to the management device 200 via the communication network. When the recorded information lacks necessary information such as an operation condition, an environmental condition or the like, the manager of the management device 200 sends the user a questionnaire asking for necessary information after feedback. Automatic transmission of feedback helps the user to complete the feedback without any trouble. In order to prevent a user's operational error, instead of the automatic transmission, the user may command feedback.

In transmission of various types of data including prediction criteria and feedback information via the communication network, correctness of the data or the feedback information is important in order to improve utility of a new discriminator. If such information is subject to an accidental error, intentional falsification or the like to cause some incorrect information to be mixed into information for generating the discriminator, the discriminator with a high degree of precision cannot be provided. Therefore, a new discriminator is preferably downloaded on a high-security home page accessible to a specific authorized user, or a securely authenticated discriminator implemented with ID (identification data) or a keyword necessary for download can be added to the image forming apparatus 100. In transmission of feedback information, an access device provided in the image forming apparatus 100 and requiring ID and a keyword necessary for upload is prepared, so as to strictly specify and restrict a feedback information provider, thereby keeping information accurate.

According to this illustrative embodiment, a fault prediction method for predicting a plurality of faults (the black toner cleaning blade failure and the magenta toner cleaning blade failure) in the image forming apparatus 100 depicted in FIG. 2 using the discriminators 105 and 108 depicted in FIG. 21 for predicting the fault according to each prediction criteria based on internal information (correction parameter Q or the like) of the image forming apparatus 100 is provided. To be specific, the fault prediction method collects a correction parameter Q or the like of the image forming apparatus 100 output from the image forming apparatus 100, generates a prediction criterion by which a fault in the magenta toner cleaning blade is detected based on the collected correction parameter Q or the like, incorporates the generated criterion into the discriminator 108 to cause the discriminator 108 to predict the magenta toner cleaning blade failure according to the prediction criterion, and outputs a prediction result, thereby generating a new criterion from internal information of the image forming apparatus 100 output from the image forming apparatus 100 in test operation or in actual operation and incorporating the criteria into the discriminator, and detecting a failure in the magenta toner cleaning blade. That is, the fault prediction method can predict an additional fault, thereby reporting a prediction result of the magenta toner cleaning blade failure to a user before occurrence thereof, so that the user can deal with the failure in advance.

As well as an image forming apparatus, many other devices experience some state change before occurrence of a failure. Therefore, by providing a detector, for example, the toner density sensors 14 and 15 depicted in FIG. 4, for detecting internal information in a device other than the image forming apparatus and generating a discriminator, for example, the discriminators 105 and 108 depicted in FIG. 21, capable of predicting a failure state from a result of detection by the detector, a user of the device can deal with the failure in advance.

As can be appreciated by those skilled in the art, although the present invention has been described above with reference to specific exemplary embodiments the present invention is not limited to the specific embodiments described above, and various modifications and enhancements are possible without departing from the scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fault prediction method for predicting a plurality of faults in a target device, the method comprising the steps of:

collecting internal information of the target device output from the target device;

generating one or more criteria for defining a deviation from a normal state based on the collected internal information of the target device;

incorporating the one or more criteria into a device state discriminator;

identifying a deviation from a normal state in the target device according to the one or more criteria using the device state discriminator;

selecting which fault in the target device is to be output to the user; and outputting a fault prediction as a result of the identifying step to a user, wherein one or more of the steps are performed by a processor, wherein a state of the device corresponding to the one or more criteria incorporated into the device state discriminator is not selected until a predetermined condition is satisfied, and wherein the result of discrimination is output as a test result differently from the selected fault in the target device until the predetermined condition is satisfied.

2. The fault prediction method according to claim 1, further comprising comparing the test result with a state of the device corresponding to the test result after output of the test result to judge whether or not the state of the device matches the test result, wherein the predetermined condition is that the state of the device matches the test result.

3. The fault prediction method according to claim 2, wherein the test result that the target device is faulty is repeatedly compared to a state of the device corresponding to the test result when the test result is output to judge whether or not the test result is appropriate, wherein the predetermined condition is that the number of times the test result is not appropriate does not equal or exceed a threshold number of times.

4. The fault prediction method according to claim 1, wherein the test result is reported to a provider of the device state discriminator.

5. The fault prediction method according to claim 4, wherein the device state discriminator is connected to a management device used by the provider of the device state discriminator via a communication network, and the test result is reported to the provider of the device state discriminator via the communication network.

6. The fault prediction method according to claim 1, wherein the target device includes an operation receiver receiving an operation by the user of the target device and a communication interface, wherein the method further comprises:

selectively predicting a fault in the target device using the device state discriminator; and selectively reporting a result of the detection according to the operation received by the operation receiver using the communication interface.

7. A fault prediction system for predicting a plurality of faults in a target device, the system comprising:

an information collector to collect internal information of the target device output from the target device;

a criterion generator to generate one or more criteria for defining a deviation from a normal state based on the internal information of the target device collected by the information collector;

a criterion incorporator to incorporate the one or more criteria into a device state discriminator;

a selector to select which fault in the target device is to be output to the user; and a communication interface to output a fault prediction made by the device state discriminator, wherein a state of the device corresponding to the one or more criteria incorporated into the device state discriminator is not selected until a predetermined condition is satisfied, and wherein the result of discrimination is output as a test result differently from the selected fault in the target device until the predetermined condition is satisfied.

8. An image forming apparatus, comprising:

a device state discriminator to predict a plurality of faults in the image forming apparatus based on internal information of the image forming apparatus;

an information collector to collect the internal information;

an input receiver to receive input of criterion data showing one or more criteria for defining a deviation from a normal state in the image forming apparatus;

a criterion incorporator to incorporate the one or more criteria into the device state discriminator; and a communication interface to output a fault prediction made by the device state discriminator to a user, wherein a state of the device corresponding to the one or more criteria incorporated into the device state discriminator is not selected until a predetermined condition is satisfied, and wherein the result of discrimination is output as a test result differently from the selected fault in the target device until the predetermined condition is satisfied.

* * * * *